US008128481B2

(12) United States Patent
Yoshizawa

(10) Patent No.: US 8,128,481 B2
(45) Date of Patent: Mar. 6, 2012

(54) GAMING MACHINE AND CONTROL METHOD OF GAMING MACHINE

(75) Inventor: Kazumasa Yoshizawa, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 420 days.

(21) Appl. No.: 12/406,366

(22) Filed: Mar. 18, 2009

(65) Prior Publication Data

US 2009/0239646 A1 Sep. 24, 2009

Related U.S. Application Data

(60) Provisional application No. 61/038,626, filed on Mar. 21, 2008.

(51) Int. Cl.
*A63F 9/24* (2006.01)

(52) U.S. Cl. ..... 463/20

(58) Field of Classification Search ..... 463/16, 463/20, 22; 273/138.1, 138.2, 139
See application file for complete search history.

(56) References Cited

U.S. PATENT DOCUMENTS 5,643,085 A * 7/1997 Aityan et al. ..... 463/9
6,168,523 B1 1/2001 Piechowiak et al.
(Continued)

*Primary Examiner* — Jarrett Stark
*Assistant Examiner* — Michele Fan
(74) *Attorney, Agent, or Firm* — NDQ&M Watchstone LLP

(57) ABSTRACT

A gaming machine includes: a plurality of first video reels 31, 31, . . . on which partial pictures of one entire sheet are arranged, respectively; and a plurality of second video reels 32, 32, . . . on which plural types of symbols are arranged, respectively. Operating a start button starts a base game. After the first video reels 31 and the second video reels have been displayed in a rotating manner on a first liquid crystal display panel 11, each of the first video reels 31 is displayed in a stopped state. Completing one entire sheet by the partial pictures displayed in a stopped state starts a second game corresponding to the competed picture. In the second game, like the base game, symbols arranged on the second video reels are employed. Thus, players can intuitively comprehend that a second game associated with the base game is started. Thereafter, an activated area is determined, and a prize is established if specific symbols have stopped in the determined activated area.

8 Claims, 20 Drawing Sheets

U.S. PATENT DOCUMENTS

2002/0025843 A1* 2/2002 Bryant ..... 463/16
2004/0204229 A1* 10/2004 Walker et al. ..... 463/20
2006/0030393 A1* 2/2006 Seelig et al. ..... 463/16
2007/0298862 A1* 12/2007 Kidneigh ..... 463/20

* cited by examiner

GAMING MACHINE AND CONTROL METHOD OF GAMING MACHINE

CROSS-REFERENCE TO RELATED APPLICATIONS

This application claims priority of U.S. Provisional Application No. 61/038,626 filed on Mar. 21, 2008. The contents of this application are incorporated herein by reference in their entirety.

BACKGROUND OF THE INVENTION

1. Field of the Invention

The present invention relates to a gaming machine and a control method of the gaming machine in which, if a predetermined condition is met in a base game, a second game is started which is different from the base game.

2. Description of the Related Art

It is known that in a conventional slot machine, if a predetermined condition is met in a base game, a second game, which is different from the base game, is started. The second game is started if specific symbols are displayed in predetermined number or more in the base game or, if a combination of a plurality of symbols employing characters coincides with a predetermined word. Such a gaming machine is disclosed in U.S. Pat. No. 6,168,523, for example.

However, through the presence or absence of specific scatter symbols or whether or not a combination of the specific scatter symbols are established, it is difficult for players to intuitively comprehend whether or not the second game has started. Further, an image which is indicative of the second game may be completely different from that which is indicative of the base game, thus making it difficult for players to comprehend association between the second game and the base game. As a result thereof, the players' confidence in the games may be impaired.

SUMMARY OF THE INVENTION

The present invention has been made in view of the above-mentioned circumstance, and aims to provide a gaming machine and a control method of the gaming machine which allows players to intuitively comprehend the fact that the second game associated with the base game has started.

A first aspect of the present invention is directed to a gaming machine, including: a liquid crystal display section for displaying a plurality of first video reels which rotate in one direction and on which partial pictures of one entire sheet are arranged, respectively, and a plurality of second video reels through which the first video reels can be seen, which rotate in a direction crossing such one direction, and on which plural types of symbols are arranged, respectively; a start accepting section, which accepts an operation of starting rotational display of the first video reels and rotational display of the second video reels; and a processor, which executes processes of: (a) starting a base game, and then, randomly determining layout positions of partial pictures in correspondence with each of the first video reels in a case where the start accepting section accepts the operation; (b) randomly determining layout positions of symbols in correspondence with each of the second video reels; (c) rotationally displaying each of the first video reels; (d) rotationally displaying each of the second video reels; (e) displaying each of the first video reels in a stopped state so that the partial pictures of each of the first video reels stop at the layout positions determined in the process (a); (f) displaying each of the second video reels in a stopped state so that symbols of each of the second video reels stop at the layout positions determined in the process (b) in a case where one entire sheet has not been completed by the partial pictures having stopped at the layout positions; (g) establishing a prize corresponding to specific symbols in a case where the stopped symbols are the specific symbols; (h) starting a second game, and then, determining an activated area in a display area of the liquid crystal display section, in a case where one entire sheet has been completed by the partial pictures having stopped at the layout position; (i) displaying the activated area determined in the process (h); (j) displaying each of the second video reels in a stopped state so that symbols of each of the second video reels stop at the layout positions determined in the process (b); and (k) establishing a prize corresponding to specific symbols or starting a second game in a case where the symbols having stopped at the layout positions are the specific symbols.

According to the aforementioned gaming machine, each of the first video reels rotates in one direction, and further, partial pictures of one entire sheet are arranged. On the other hand, the second video reels allow the first video reels to be seen therethrough and rotate in a direction crossing a direction in which the first video reels rotate, and plural types of symbols are arranged. The liquid crystal display section is for displaying the pluralities of the first and second video reels, respectively.

The player at the gaming machine operates the start accepting section starting rotation displays of the first and second video reels. If the start accepting section has accepted the operation, the processor executes the process (a). The process (a) is executed, whereby the base game is started, and then, the layout positions of the partial pictures are randomly determined in correspondence with the first video reels. Further, the processor executes the process (b), whereby the layout positions of the symbols are randomly determined in correspondence with the second video reels.

The processor executes the processes (c) and (d), whereby the first video reels are displayed in a rotating state at the liquid crystal display section, and then, the second video reels are displayed in a rotating state. Further, the processor executes the process (e), whereby the first video reels are displayed in a stopped state, and at this time, the partial pictures of the first video reels stop at the layout positions determined in the process (a). Where the layout positions of the partial pictures are appropriate, one entire sheet completes.

If one entire sheet has not been completed by the partial pictures having stopped at the layout positions determined in the process (a), the processor executes the processes (f) and (g), whereby the second video reels are displayed in a stopped state, and at this time, the symbols of the second video reels stop at the layout positions determined in the process (b). Further, if specific symbols have stopped, the prize corresponding to the specific symbols is established. The thus established prizes are directly awarded to players, or alternatively, are awarded to the players after they are conveniently accumulated.

If one entire sheet has been completed by the partial pictures having stopped at the layout positions determined in the process (a), the processor executes the process (h), whereby the second game is started. Namely, if each of the first video reels is displayed in a stopped state, when one entire sheet has not been completed, the base game is performed to the end, and when one entire sheet has been completed, the second game is started. Thus, the player can intuitively comprehend whether or not the second game has started.

The processor executes the process (h), whereby the activated area is determined in the display area of the liquid crystal display section. Namely, in the second game, like the base game, the symbols arranged on the second video reels are employed. Therefore, the image indicative of the second game is analogous to that indicative of the base game, and the player can easily comprehend association between the second game and the base game. As a result thereof, the player's confidence in the games can be obtained.

Further, the processor executes the process (i), whereby the activated area determined in the process (h) is displayed. Thus, the player can easily keep track of where the specific symbols should stop to award a prize, by visually recognizing the activated area displayed at the liquid crystal display section.

The processor executes the process (j), whereby each of the second video reels is displayed in a stopped state, and at this time, the symbols of each of the second video reels stop at the layout positions determined in the process (b). Further, the processor executes the process (k), whereby, if the specific symbols have stopped in the activated area, the prize corresponding to the specific symbols is established, or alternatively, the second game is started. In other words, the second game may be a game for awarding prizes to players or may be a game triggered to start a new game for awarding prize to players.

A second aspect of the present invention is directed to the gaming machine, wherein: the process (h) is a process of starting a second game, and then, determining an activated area in a display area of the liquid crystal display section, in a case where one entire sheet has been completed by the partial pictures having stopped at the layout position.

According to the aforementioned gaming machine, the processor executes the process (h), whereby the activated area is randomly determined in the display area of the liquid crystal display section. In other words, the activated area is automatically determined without intervening the player's operation, so that the player can concentrate one's consciousness on the game outcome.

A third aspect of the present invention is directed to the gaming machine, further including a selection accepting section, which accepts an area selection in a case where a second game is started, wherein: the process (h) is a process of starting the second game, and then, determining an activated area as the area accepted by the selection accepting section, in the display area of the liquid crystal display section.

According to the aforementioned gaming machine, the player operates the selection accepting section, and then, selects the area to be formed as the activated area if the second game is started. If the selection accepting section has accepted the area selection, the processor executes the process (h), whereby the activated area is determined as the area accepted by the selection accepting section. In other words, the activated area is manually determined by the player operation, so that the player can recognize one's own intention in games.

A fourth aspect of the present invention is directed to the gaming machine, wherein: the process (i) is a process of displaying the activated area in a state in which luminance of the activated area determined in the process (h) is higher than luminance of a display area other than the activated area.

According to the aforementioned gaming machine, the processor executes the process (i), whereby the activated area determined in the process (h) is displayed in a state in which the luminance of this activated area is higher than that of a display area other than the activated area. Thus, the player can easily visually recognize the layout position of the activated area in accordance with the level of the luminance in the display area of the liquid crystal display section, and can easily keep track of where the specific symbols should stop to award the prize, by visually recognizing the activated area displayed at the liquid crystal display section.

A fifth aspect of the present invention is directed to a gaming machine, including: liquid crystal display section for displaying a plurality of first video reels which rotate in one direction and on which partial pictures of one entire sheet are arranged, respectively, and a plurality of second video reels through which the first video reels can be seen, which rotates in a direction crossing such one direction, and on which plural types of symbols are arranged, respectively; a start accepting section, which accepts an operation of starting rotational display of the first video reels and rotational display of the second video reels; and a processor, which executes processes of: (a) starting a base game, and then, randomly determining layout positions of partial pictures in correspondence with each of the first video reels in a case where the start accepting section accepts the operation; (b) randomly determining layout positions of symbols in correspondence with each of the second video reels; (c) rotationally displaying each of the first video reels; (d) rotationally displaying each of the second video reels; (e) displaying each of the first video reels in a stopped state so that the partial pictures of each of the first video reels stop at the layout positions determined in the process (a); (f) displaying each of the second video reels in a stopped state so that symbols of each of the second video reels stop at the layout positions determined in the process (b) in a case where one entire sheet has not been completed by the partial pictures having stopped at the layout positions; (g) establishing a prize corresponding to specific symbols in a case where the stopped symbols are the specific symbols; (h) starting a second game, and then, determining an activated area in a display area of the liquid crystal display section, in a case where one entire sheet has been completed by the partial pictures having stopped at the layout position; (i) displaying the activated area in a state in which luminance of the activated area determined in the process (h) is higher than luminance of a display area other than the activated area; (j) displaying each of the second video reels in a stopped state so that symbols of each of the second video reels stop at the layout positions determined in the process (b); and (k) establishing a prize corresponding to specific symbols or starting a second game in a case where the symbols having stopped at the layout positions are the specific symbols.

According to the aforementioned gaming machine, each of the first video reels rotates in one direction, and partial pictures of one entire sheet are arranged. Meanwhile, the second video reels allow the first video reels to be seen therethrough and rotate in a direction crossing the direction in which the first video reels rotate, and further, plural types of symbols are arranged. The liquid crystal display section is for displaying the pluralities of the first and second video reels, respectively.

The player at the gaming machine operates the start accepting section upon starting rotation displays of the first and second video reels. If the start accepting section has accepted the operation, the processor executes the process (a). The process (a) is executed, whereby the base game is started, and then, the layout positions of the partial pictures are randomly determined in correspondence with the first video reels. Further, the processor executes the process (b), whereby the layout positions of the symbols are randomly determined in correspondence with the second video reels.

The processor executes the processes (c) and (d), whereby the first video reels are displayed in a rotating state at the liquid crystal display section, and the second video reels are displayed in a rotating state. Further, the processor executes the process (e), whereby the first video reels are displayed in a stopped state, and at this time, the partial pictures of the first video reels stop at the layout positions determined in the process (a). Where the layout positions of the partial pictures are appropriate, one entire sheet completes.

If one entire sheet has not been completed by the partial pictures having stopped at the layout positions determined in the process (a), the processor executes the processes (f) and (g), whereby the second video reels are displayed in a stopped state, and at this time, the symbols of the second video reels stop at the layout positions determined in the process (b). The thus established prizes are directly awarded to players, or alternatively, are awarded to the players after they are appropriately accumulated.

If one entire sheet has been completed by the partial pictures having stopped at the layout positions determined in the process (a), the processor executes the process (h), whereby the second game is started. Namely, if each of the first video reels is displayed in a stopped state, when one entire sheet has not been completed, the base game is performed to the end, and when one entire sheet has been completed, the second game is started. Thus, the player can intuitively comprehend whether or not the second game is started.

The processor executes the process (h), whereby the activated area is determined in the display area of the liquid crystal display section. Therefore, the image indicative of the second game is analogous to that indicative of the base game, and the player can easily comprehend association between the second game and the base game. As a result thereof, the player's reliability relative to games can be obtained. Moreover, the activated area is automatically determined without intervening the player's operation, so that the player can concentrate one's consciousness on the game outcome.

Further, the processor executes the process (i), whereby the activated area determined in the process (h) is displayed. Thus, by visually recognizing the activated area displayed at the liquid crystal display section, the player can easily keep track of where the specific symbols should stop to receive a prize.

The processor executes the process (j), whereby each of the second video reels is displayed in a stopped state, and at this time, the symbols of each of the second video reels stop at the layout positions determined in the process (b). Further, the processor executes the process (k), whereby, if the specific symbols have stopped in the activated area, the prize corresponding to the specific symbols is established, or alternatively, the second game is started. In other words, the second game may be a game for awarding prizes to players or may be a game triggered to start a further game for awarding prize to players.

A sixth aspect of the present invention is directed to a gaming machine, including: a liquid crystal display section for displaying a plurality of first video reels which rotate in one direction and on which partial pictures of one entire sheet are arranged, respectively, and a plurality of second video reels through which the first video reels can be seen, which rotates in a direction crossing such one direction, and on which plural types of symbols are arranged, respectively; a start accepting section, which accepts an operation of starting rotational display of the first video reels and rotational display of the second video reels; and a processor, which executes processes of: (a) starting a base game, and then, randomly determining layout positions of partial pictures in correspondence with each of the first video reels in a case where the start accepting section accepts the operation; (b) randomly determining layout positions of symbols in correspondence with each of the second video reels; (c) rotationally displaying each of the first video reels; (d) rotationally displaying each of the second video reels; (e) displaying each of the first video reels in a stopped state so that the partial pictures of each of the first video reels stop at the layout positions determined in the process (a); (f) displaying each of the second video reels in a stopped state so that symbols of each of the second video reels stop at the layout positions determined in the process (b) in a case where one entire sheet has not been completed by the partial pictures having stopped at the layout positions; (g) establishing a prize corresponding to specific symbols in a case where the stopped symbols are the specific symbols; (h) starting a second game, and then, determining an activated area in a display area of the liquid crystal display section, in a case where one entire sheet has been completed by the partial pictures having stopped at the layout position; (i) displaying the activated area in a state in which luminance of the activated area determined in the process (h) is higher than luminance of a display area other than the activated area; (j) displaying each of the second video reels in a stopped state so that symbols of each of the second video reels stop at the layout positions determined in the process (b); and (k) establishing a prize corresponding to specific symbols or starting a second game in a case where the symbols having stopped at the layout positions are the specific symbols.

According to the aforementioned gaming machine, each of the first video reels rotates in one direction, and partial pictures of one entire sheet are arranged. Meanwhile, the second video reels allow the first video reels to be seen therethrough and rotate in a direction crossing the direction in which the first video reels rotate, and plural types of symbols are arranged. The liquid crystal display section is for displaying the pluralities of the first and second video reels, respectively.

The player at the gaming machine operates the start accepting section upon starting rotation displays of the first and second video reels. If the start accepting section has accepted the operation, the processor executes the process (a). The process (a) is executed, whereby the base game is started, and then, the layout positions of the partial pictures are randomly determined in correspondence with the first video reels. Further, the processor executes the process (b), whereby the layout positions of the symbols are randomly determined in correspondence with the second video reels.

The processor executes the processes (c) and (d), whereby the first video reels are displayed in a rotating state at the liquid crystal display section, and the second video reels are displayed in a rotating state. Further, the processor executes the process (e), whereby the first video reels are displayed in a stopped state, and at this time, the partial pictures of the first video reels stop at the layout positions determined in the process (a). Where the layout positions of the partial pictures are appropriate, one entire sheet completes.

If one entire sheet has not been completed by the partial pictures having stopped at the layout positions determined in the process (a), the processor executes the processes (f) and (g), whereby the second video reels are displayed in a stopped state, and at this time, the symbols of the second video reels stop at the layout positions determined in the process (b). Further, if specific symbols have stopped, the prize corresponding to the specific symbols is established. The thus established prizes are directly awarded to players, or alternatively, are awarded to the players after they are conveniently accumulated.

If one entire sheet has been completed by the partial pictures having stopped at the layout positions determined in the process (a), the processor executes the process (h), whereby the second game is started. Namely, if each of the first video reels is displayed in a stopped state, when one entire sheet has not been completed, the base game is performed to the end, and when one entire sheet has been completed, the second game is started. Thus, the player can intuitively comprehend whether or not the second game has started.

The processor executes the process (h), whereby the activated area is determined in the display area of the liquid crystal display section. Namely, in the second game, like the base game, the symbols arranged on the second video reels are employed. Therefore, the image indicative of the second game is analogous to that indicative of the base game, and the player can easily comprehend association between the second game and the base game. As a result thereof, the player's reliability relative to games can be obtained. Moreover, the activated area is automatically determined without intervening the player's operation, so that the player can concentrate one's consciousness on the game outcome.

Further, the processor executes the process (i), whereby the activated area determined in the process (h) is displayed. Thus, the player can easily keep track of where the specific symbols should stop to award a prize, by visually recognizing the activated area displayed at the liquid crystal display section.

The processor executes the process (j), whereby each of the second video reels is displayed in a stopped state, and at this time, the symbols of each of the second video reels stop at the layout positions determined in the process (b). Further, the processor executes the process (k), whereby, if the specific symbols have stopped in the activated area, the prize corresponding to the specific symbols is established, or alternatively, the second game is started. In other words, the second game may be a game for awarding prizes to players or may be a game triggered to start a further game for awarding prize to players.

A seventh aspect of the present invention is directed to a gaming machine, including: a liquid crystal display section for displaying a plurality of first video reels which rotate in one direction and on which partial pictures of one entire sheet are arranged, respectively, and a plurality of second video reels through which the first video reels can be seen, which rotates in a direction crossing such one direction, and on which plural types of symbols are arranged, respectively; a start accepting section, which accepts an operation of starting rotational display of the first video reels and rotational display of the second video reels; and a processor, which executes processes of: (a) starting a base game, and then, randomly determining layout positions of partial pictures in correspondence with each of the first video reels in a case where the start accepting section accepts the operation; (b) randomly determining layout positions of symbols in correspondence with each of the second video reels; (c) rotationally displaying each of the first video reels; (d) rotationally displaying each of the second video reels; (e) displaying each of the first video reels in a stopped state so that the partial pictures of each of the first video reels stop at the layout positions determined in the process (a); (f) displaying each of the second video reels in a stopped state so that symbols of each of the second video reels stop at the layout positions determined in the process (b) in a case where one entire sheet has not been completed by the partial pictures having stopped at the layout positions; (g) establishing a prize corresponding to specific symbols in a case where the stopped symbols are the specific symbols; (h) starting a second game, and then, determining an activated area in a display area of the liquid crystal display section, in a case where one entire sheet has been completed by the partial pictures having stopped at the layout position; (i) displaying the activated area in a state in which luminance of the activated area determined in the process (h) is higher than luminance of a display area other than the activated area; (j) displaying each of the second video reels in a stopped state so that symbols of each of the second video reels stop at the layout positions determined in the process (b); and (k) establishing a prize corresponding to specific symbols or starting a second game in a case where the symbols having stopped at the layout positions are the specific symbols.

According to the aforementioned gaming machine, each of the first video reels rotates in one direction, and partial pictures of one entire sheet are arranged. On the other hand, the second video reels allow the first video reels to be seen therethrough and rotate in a direction crossing the direction in which the first video reels rotate, and further, plural types of symbols are arranged. The liquid crystal display section is for displaying the pluralities of each of the first and second video reels.

The player at the gaming machine operates the start accepting section upon starting rotation displays of the first and second video reels. If the start accepting section has accepted the operation, the processor executes the process (a). The process (a) is executed, whereby the base game is started, and then, the layout positions of the partial pictures are randomly determined in correspondence with the first video reels. Further, the processor executes the process (b), whereby the layout positions of the symbols are randomly determined in correspondence with the second video reels.

The processor executes the processes (c) and (d), whereby the first video reels are displayed in a rotating state at the liquid crystal display section, and the second video reels are displayed in a rotating state. Further, the processor executes the process (e), whereby the first video reels are displayed in a stopped state, and at this time, the partial pictures of the first video reels stop at the layout positions determined in the process (a). Where the layout positions of the partial pictures are appropriate, one entire sheet completes.

If one entire sheet has not been completed by the partial pictures having stopped at the layout positions determined in the process (a), the processor executes the processes (f) and (g), whereby the second video reels are displayed in a stopped state, and at this time, the symbols of the second video reels stop at the layout positions determined in the process (b). Further, if specific symbols have stopped, the prize corresponding to the specific symbols is established. The thus established prizes are directly awarded to players, or alternatively, are awarded to the players after they are appropriately accumulated.

If one entire sheet has been completed by the partial pictures having stopped at the layout positions determined in the process (a), the processor executes the process (h), whereby the second game is started. Namely, if each of the first video reels is displayed in a stopped state, when one entire sheet has not been completed, the base game is performed to the end, and when one entire sheet has been completed, the second game is started. Thus, the player can intuitively comprehend whether or not the second game has started.

The processor executes the process (h), whereby the activated area is determined in the display area of the liquid crystal display section. Namely, in the second game, like the base game, the symbols arranged on the second video reels are employed. Therefore, the image indicative of the second game is analogous to that indicative of the base game, and the player can easily comprehend association between the second game and the base game. As a result thereof, the player's confidence in games can be obtained. Moreover, the activated area is automatically determined without intervening the player's operation, so that the player can concentrate one's consciousness on the game outcome.

Further, the processor executes the process (i), whereby the activated area determined in the process (h) is displayed and the luminance of this area is of a level higher than that of the area outside the active area. Thus, the player can easily keep track of where the specific symbols should stop to award a prize, by visually recognizing the activated area displayed at the liquid crystal display section.

The processor executes the process (j), whereby each of the second video reels is displayed in a stopped state, and at this time, the symbols of each of the second video reels stop at the layout positions determined in the process (b). Further, the processor executes the process (k), whereby, if the specific symbols have stopped in the activated area, the prize corresponding to the specific symbols is established, or alternatively, the second game is started. In other words, the second game may be a game for awarding prizes to players or may be a game triggered to start a further game for awarding prize to players.

An eighth aspect of the present invention is directed to a gaming machine, including: a plurality of mechanical reels, which rotate in one direction and on which partial pictures of one entire sheet are arranged, respectively; a liquid crystal display section for displaying a plurality of video reels through which the mechanical reels can be seen, which rotate in such one direction, and on which plural types of symbols are arranged, respectively; a start accepting section, which accepts an operation of starting rotation of the mechanical reels and rotational display of the video reels; and a processor, which executes processes of: (a) starting a base game, and then, randomly determining layout positions of partial pictures in correspondence with each of the first video reels in a case where the start accepting section accepts the operation; (b) randomly determining layout positions of symbols in correspondence with each of the video reels; (c) rotating each of the mechanical reels; (d) rotationally displaying each of the video reels; (e) stopping each of the mechanical reels so that partial pictures of each of the mechanical reels stop at the layout positions determined in the process (a); (f) displaying each of the video reels in a stopped state so that symbols of each of the video reels stop at the layout positions determined in the process (b) in a case where one entire sheet has not been completed by the partial pictures having stopped at the layout positions; (g) establishing a prize corresponding to specific symbols in a case where the symbols having stopped are the specific symbols; (h) starting a second game, and then, determining an activated area in a display area of the liquid crystal display section, in a case where one entire sheet has been completed by the partial pictures having stopped at the layout position; (i) displaying the activated area determined in the process (h); (j) displaying each of the video reels in a stopped state so that symbols of each of the video reels stop at the layout positions determined in the process (b); and (k) establishing a prize corresponding to specific symbols or starting a second game in a case where the symbols having stopped at the layout positions are the specific symbols.

According to the aforementioned gaming machine, each of the first video reels rotates in one direction, and partial pictures of one entire sheet are arranged. On the other hand, the second video reels allow the first video reels to be seen therethrough and rotate in a direction crossing the direction in which the first video reels rotate, and further, plural types of symbols are arranged. The liquid crystal display section is for displaying the pluralities of the first and second video reels, respectively.

The player at the gaming machine operates the start accepting section upon starting rotation displays of the first and second video reels. If the start accepting section has accepted the operation, the processor executes the process (a). The process (a) is executed, whereby the base game is started, and then, the layout positions of the partial pictures are randomly determined in correspondence with the first video reels. Further, the processor executes the process (b), whereby the layout positions of the symbols are randomly determined in correspondence with each of the video reels.

The processor executes the processes (c) and (d), whereby the first video reels are displayed in a rotating state at the liquid crystal display section, and the second video reels are displayed in a rotating state. Further, the processor executes the process (e), whereby the first video reels are displayed in a stopped state, and at this time, the partial pictures of the first video reels stop at the layout positions determined in the process (a). Where the layout positions of the partial pictures are appropriate, one entire sheet completes.

If one entire sheet has not been completed by the partial pictures having stopped at the layout positions determined in the process (a), the processor executes the processes (f) and (g), whereby the second video reels are displayed in a stopped state, and at this time, the symbols of the second video reels stop at the layout positions determined in the process (b). Further, if specific symbols have stopped, the prize corresponding to the specific symbols is established. The thus established prizes are directly awarded to players, or alternatively, are awarded to the players after they are appropriately accumulated.

If one entire sheet has been completed by the partial pictures having stopped at the layout positions determined in the process (a), the processor executes the process (h), whereby the second game is started. Namely, if each of the first video reels is displayed in a stopped state, when one entire sheet has not been completed, the base game is performed to the end, and when one entire sheet has been completed, the second game is started. Thus, the player can intuitively comprehend whether or not the second game has started.

The processor executes the process (h), whereby the activated area is determined in the display area of the liquid crystal display section. Namely, in the second game, like the base game, the symbols arranged on the second video reels are employed. Therefore, the image indicative of the second game is analogous to that indicative of the base game, and the player can easily comprehend association between the second game and the base game. As a result thereof, the player's reliability relative to games can be obtained. Moreover, the activated area is automatically determined without intervening the player's operation, so that the player can concentrate one's consciousness on the game outcome.

Further, the processor executes the process (i), whereby the activated area determined in the process (h) is displayed. Thus, the player can easily keep track of where the specific symbols should stop to award a prize, by visually recognizing the activated area displayed at the liquid crystal display section.

The processor executes the process (j), whereby each of the second video reels is displayed in a stopped state, and at this time, the symbols of each of the second video reels stop at the layout positions determined in the process (b). Further, the processor executes the process (k), whereby, if the specific symbols have stopped in the activated area, the prize corresponding to the specific symbols is established, or alternatively, the second game is started. In other words, the second game may be a game for awarding prizes to players or may be a game triggered to start a further game for awarding prizes to players.

A ninth aspect of the present invention is directed to a control method of a gaming machine which has: a liquid crystal display section for displaying a plurality of first video reels which rotate in one direction and on which partial pictures of one entire sheet are arranged, respectively, and a plurality of second video reels through which the first video reels can be seen, which rotates in a direction crossing such one direction, and on which plural types of symbols are arranged, respectively; and a start accepting section, which accepts an operation of starting rotational display of the first video reels and rotational display of the second video reels, the method including the steps of: (a) starting a base game, and then, randomly determining layout positions of partial pictures in correspondence with each of the first video reels in a case where the start accepting section accepts the operation; (b) randomly determining layout positions of symbols in correspondence with each of the second video reels; (c) rotationally displaying each of the first video reels; (d) rotationally displaying each of the second video reels; (e) displaying each of the first video reels in a stopped state so that the partial pictures of each of the first video reels stop at the layout positions determined in the process (a); (f) displaying each of the second video reels in a stopped state so that symbols of each of the second video reels stop at the layout positions determined in the process (b) in a case where one entire sheet has not been completed by the partial pictures having stopped at the layout positions; (g) establishing a prize corresponding to specific symbols in a case where the stopped symbols are the specific symbols; (h) starting a second game, and then, determining an activated area in a display area of the liquid crystal display section, in a case where one entire sheet has been completed by the partial pictures having stopped at the layout position; (i) displaying the activated area determined in the process (h); (j) displaying each of the second video reels in a stopped state so that symbols of each of the second video reels stop at the layout positions determined in the process (b); and (k) establishing a prize corresponding to specific symbols or starting a second game in a case where the symbols having stopped at the layout positions are the specific symbols.

According to the control method of the game machine, for example, the gaming machine of the present invention can be controlled.

DETAILED DESCRIPTION OF THE INVENTION

First Embodiment

[1-1. Overview of the Present Invention]

Figure 1A:
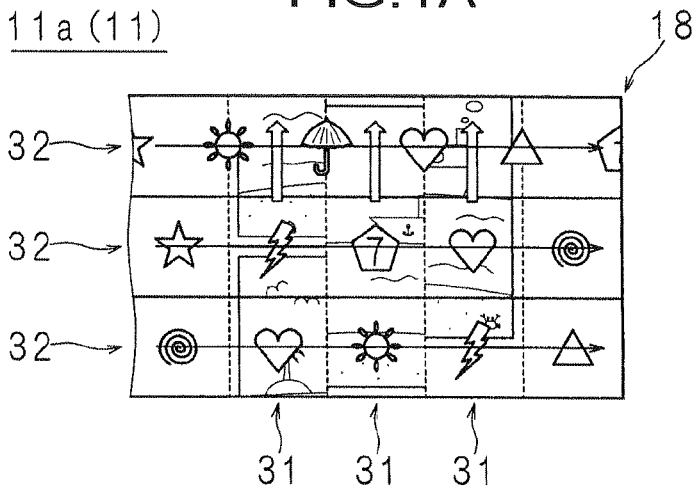
FIGS. 1A to 1C are views showing characteristics of a gaming machine according to a first embodiment of the present invention.
Figure 1B:
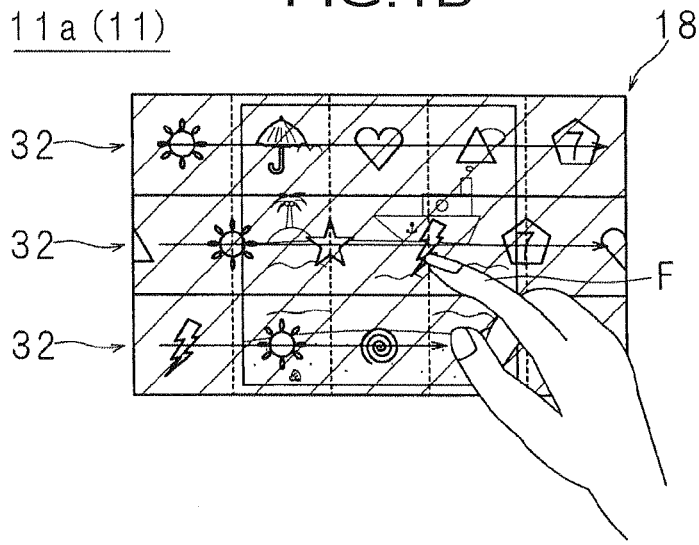
Figure 1C:
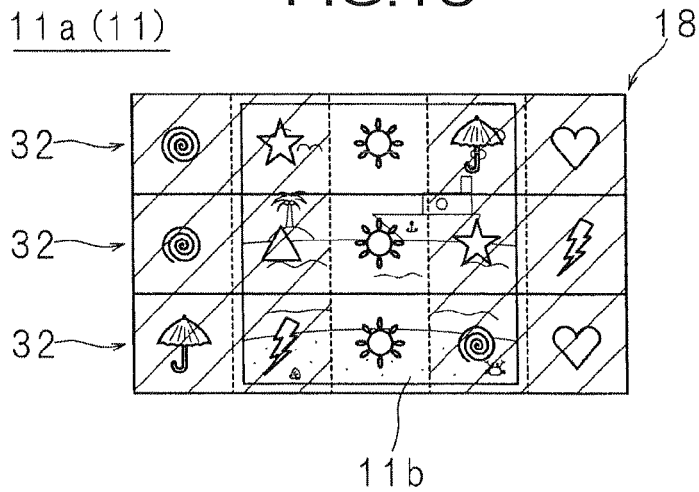

Hereinafter, embodiments of the present invention will be described referring to the drawings. FIGS. 1A to 1C are views showing characteristics of a gaming machine according to a first embodiment of the present invention. A gaming machine 1 (see FIGS. 2 and 10) is provided with: a first liquid crystal display panel 11; and a touch panel 18 which is disposed on the first liquid crystal display panel 11 in a layered manner. The first liquid crystal display panel 11 functions as a liquid crystal display section, and the touch panel 18 functions as a selection accepting section.

As shown in FIG. 1A, the first liquid crystal display panel 11 displays pluralities of first video reels 31, 31, . . . and second video reels 32, 32, . . . , respectively. In the present embodiment, the first video reels 31, 31, . . . and the second video reels 32, 32, . . . are displayed on a three-by-three reels basis, respectively. Each of the first video reels 31 is displayed in a rotating state in the direction indicated by the outline arrow shown in FIG. 1A (i.e., in an upward direction). Further, a partial picture of one entire sheet is arranged on each of the first video reels 31. The second video reels 32 allow the first video reels 31, 31, . . . , to be seen therethrough, and each of the second video reels 32 is displayed in a rotating state in the direction indicated by the arrows orthogonal to that indicated by the aforesaid upward-direction outline arrows in FIG. 1A (i.e. in a rightward direction). Further, a plurality of symbols is arranged on each of the second video reels 32.

Figure 2:
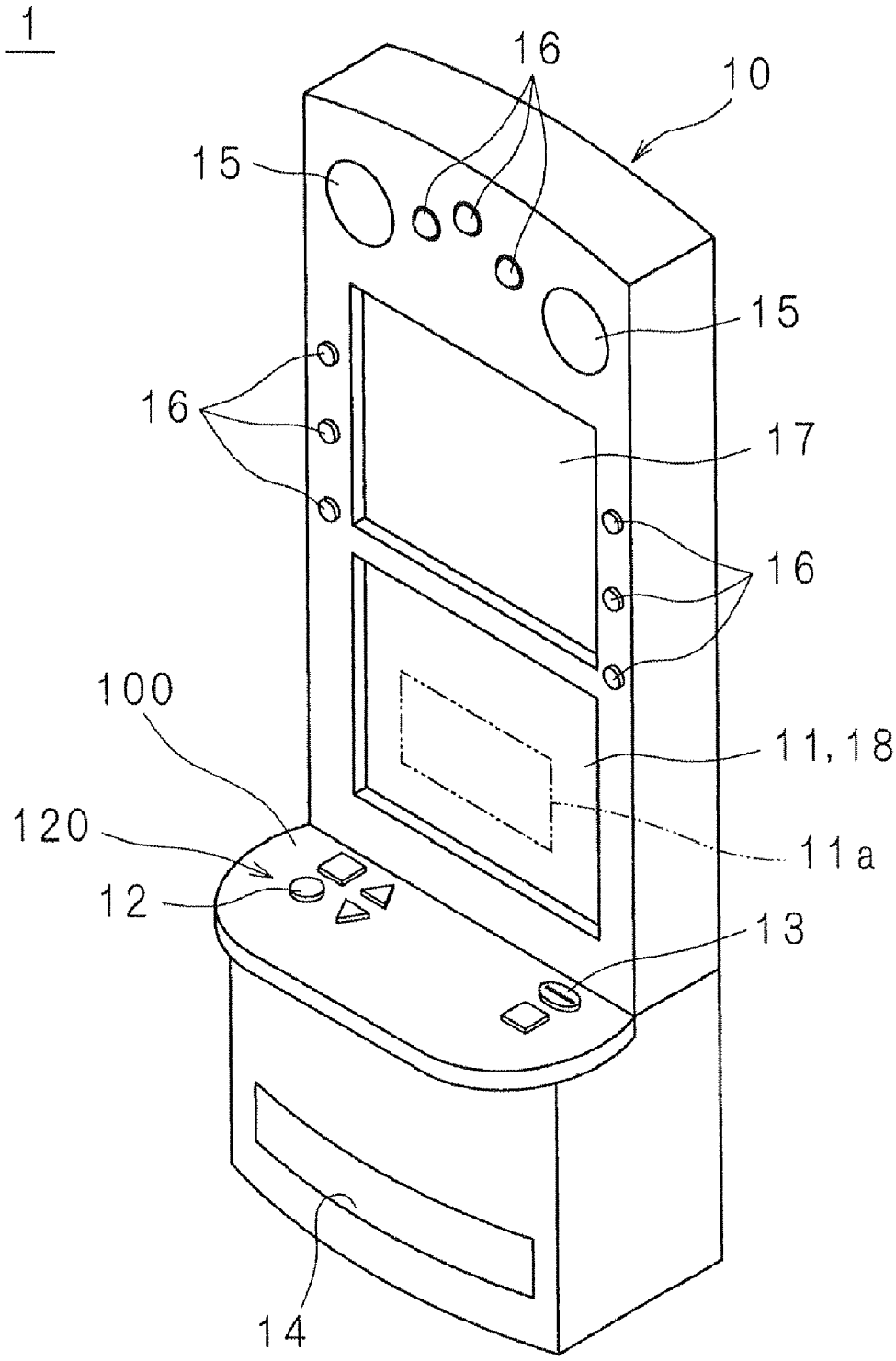
FIG. 2 is a perspective view showing an appearance of the gaming machine according to the first embodiment of the present invention.
Figure 10:
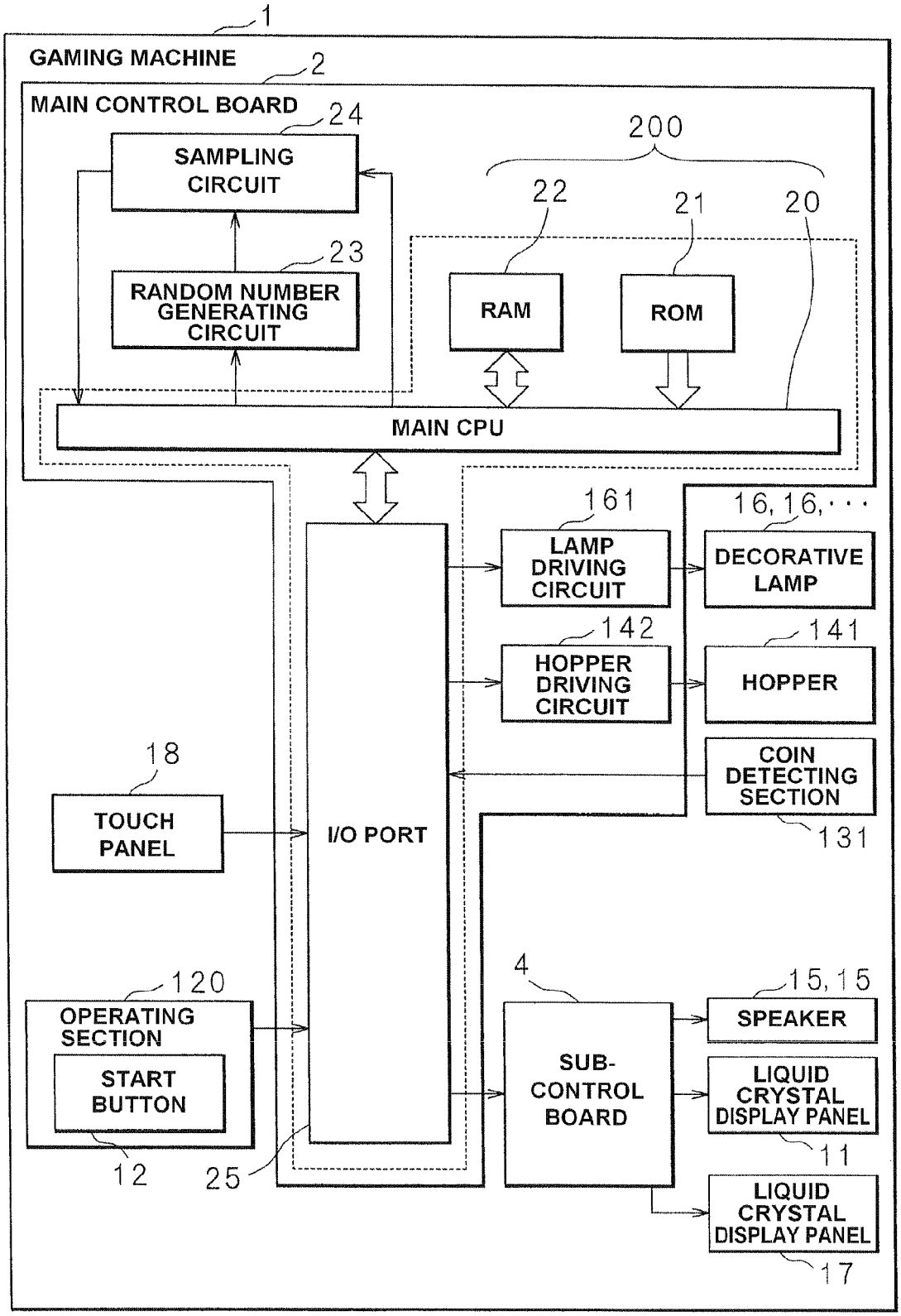
FIG. 10 is a block diagram depicting a configuration of essential portions of the gaming machine according to the first embodiment of the present invention.

A gaming machine 1 is provided with a start button 12 (see FIGS. 2 and 10). When a player of the gaming machine 1 operates a start button 12 the rotational display of the first video reels 31, 31, . . . and that of the second video reels 32, 32, . . . are started. The start button 12 functions as a start accepting section.

When the start button 12 is operated, a base game is started. Thereafter, the first liquid crystal display panel 11 displays a base game image indicating the progress of the base game. Further, the layout positions of partial pictures are randomly determined in correspondence with each of the first video reels 31, and in correspondence with each of the second video reels 32. Moreover, as shown in FIG. 1A, each of the first video reels 31 is displayed in a rotating state on the first liquid crystal display panel 11 in the direction indicated by the outline arrow, and each of the video reels 32 is displayed in a rotating state in the direction indicated by the arrow. Then, each of the first video reels 31 is displayed in a stopped state. At this time, the partial pictures of each of the first video reels 31 stop at a determined layout position. Where the layout positions of the partial pictures are appropriate, one of plural kinds of pictures completes.

If one entire sheet is not completed by the partial pictures that stopped at the determined layout positions, each of the second video reels 32 are displayed in a stopped state. At this time, the symbols of each of the second video reels 32 stop at the determined layout positions. If the stopped symbols are pre-specified, a prize corresponding thereto is established. The thus established prizes are directly awarded to players, or alternatively, are awarded to the players after they have been conveniently accumulated. In the present embodiment, the resultant prizes are directly awarded to the players in the form of coin payouts. If the stopped symbols are not pre-specified ones, no prize is established.

When one entire sheet has been completed by partial pictures stopped in a determined layout position, a second game corresponding to the completed picture is started. If each of the first video reels 31 is displayed in a stopped state where one entire sheet is not completed, a base game is performed to the end and when one entire sheet is completed, a second game is started. Thus, the players can intuitively comprehend whether or not the second game has started.

If the second game is started, a player operates the touch panel 18 with a finger F, as shown in FIG. 1B, and then, selects an area to be formed as an activated area 11*b* as shown in FIG. 1C. If the touch panel 18 has accepted an area selection, the activated area 11*b* is determined as an area accepted by the touch panel 18 in the display area 11*a* of the first liquid crystal display panel 11.

At this time, the determined activated area 11*b* is displayed on the first liquid crystal display panel 11 in a state in which the luminance of this activated area 11*b* is higher than that of the display area 11*a* other than this activated area 11*b*. Accordingly, players can easily visually recognize the layout position of the activated area 11*b* in accordance with the level of the luminance in the display area 11*a* of the first liquid crystal display panel 11, and can easily keep track of where specific symbols are to be stopped so as to award prizes, by visually recognizing the activated area 11*b* displayed on the first liquid crystal display panel 11.

Lastly, each of the second video reels 32 is displayed in a stopped state, and at this time, symbols of each of the second video reels 32 are stopped in a determined layout position. Further, if specific symbols have stopped in the activated area 11*b*, the prize corresponding to the specific symbols is established. In the second game, like the base game, the symbols arranged on the second video reels 32, 32, . . . are employed. Consequently, an image indicating the progress of the second game resembles that of the base game, and players can easily comprehend association between the second game and the base game. As a result thereof, the player's confidence in the games can be obtained. Moreover, the activated area 11*b* is manually determined by the player operation, so that the players can reflect their own will on games.

If specific symbols have been stopped in the activated area 11*b*, a feature game may be started in place of receiving the prize corresponding to the specific symbols. In other words, the second game may be a game for awarding prizes to players, or alternatively, may be a game which is triggered to start a further game for awarding prizes to players.

[1-2. Configuration of the Gaming Machine]

FIG. 2 is a perspective view showing an exterior appearance of the gaming machine according to the first embodiment of the present invention. The gaming machine 1 is installed in an amusement place such as casino. The gaming machine 1 is provided with a casing 10 which houses electrical or mechanical parts for performing a predetermined base game and a second game. The base game corresponds to a slot game.

A first liquid crystal display panel 11 formed in a rectangular shape is arranged at the lower side of the frontal center of the casing 10, and a touch panel 18, which is substantially identical to the first liquid crystal display panel 11 in dimensions and shape, is layered at the front side of the first liquid crystal display panel 11. The touch panel 18 has no color and is transparent, and does not hinder the players' visual recognition of the liquid crystal display panel 11. Although not shown, a backlight is arranged at the rear side of the first liquid crystal display panel 11.

When a game is performed, a rectangular display area 11*a* is displayed at the center of the first liquid crystal display panel 11. On the display area 11*a*, a game image indicating the progress of a base game or a second game, is displayed. A display area other than the display area 11*a* displays an effect image for augmenting a game, an instruction for a player, a remaining number of coins accumulated in the gaming machine 1, and a value of BET, for example.

A second liquid crystal display panel 17 is arranged at the upper side of the frontal center of the cabinet 10. When a game is performed, the second liquid crystal display panel 17 displays an effect image for augmenting the game. Each of the liquid crystal display panels 11, 17 displays an image which is based upon the data stored in the image ROM 55 (see FIG. 11).

At the frontal upper part of the cabinet 10, speakers 15, 15 are disposed in such a way that they are spaced from each other at the right and left sides. Further, a number of decorative lamps 16, 16, . . . are arranged at the frontal periphery of the cabinet 10. An operating console 100, which is intended for a player to operate the gaming machine 1, is provided at the frontal lower part of the cabinet 10. On the top face of the operating console 100, an operating section 120 operable by a player and a coin insertion slot 13 designed for a player to insert a coin are provided. At the lower part of the operating console 100, a coin tray 14 is provided. At the operating section 120, a start button 12 and various types of other operational buttons such as a BET button and a CASHOUT button are provided.

In the gaming machine 1 of the embodiment, coins are employed as gaming media. In addition to coins, other gaming media such as bills, securities, medals, tokens, electronic money, and tickets may be employed.

Figure 3:
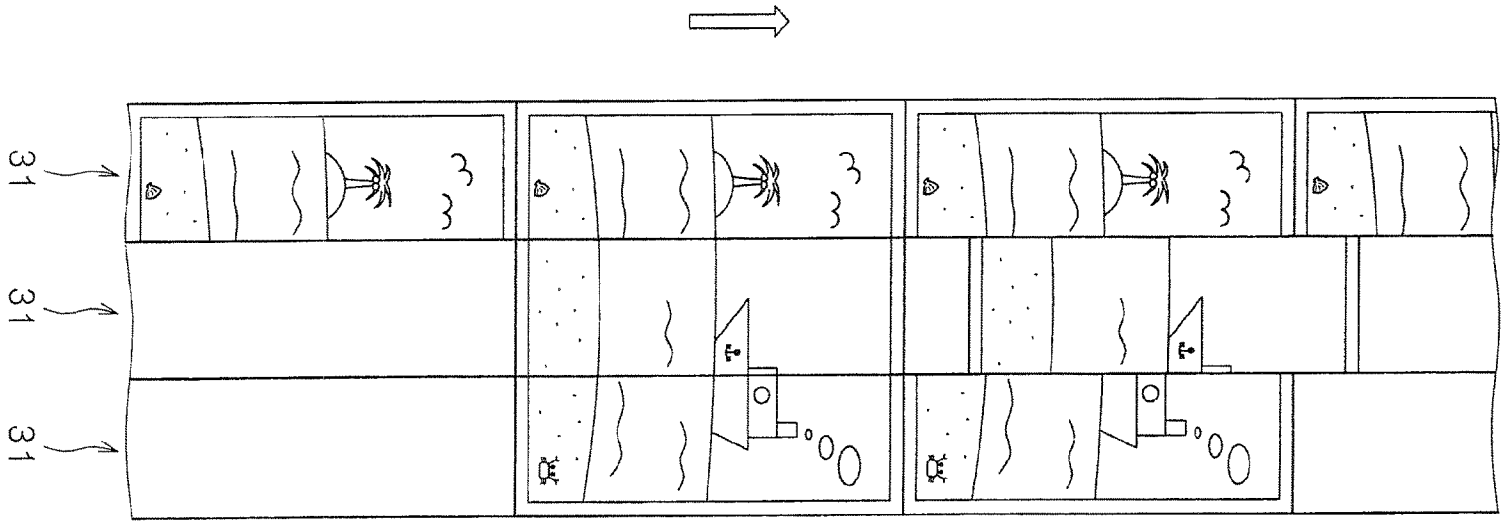
FIG. 3 is a schematic view showing exemplary first video reels displayed on a first liquid crystal display panel included in the gaming machine according to the first embodiment of the present invention.
Figure 4:
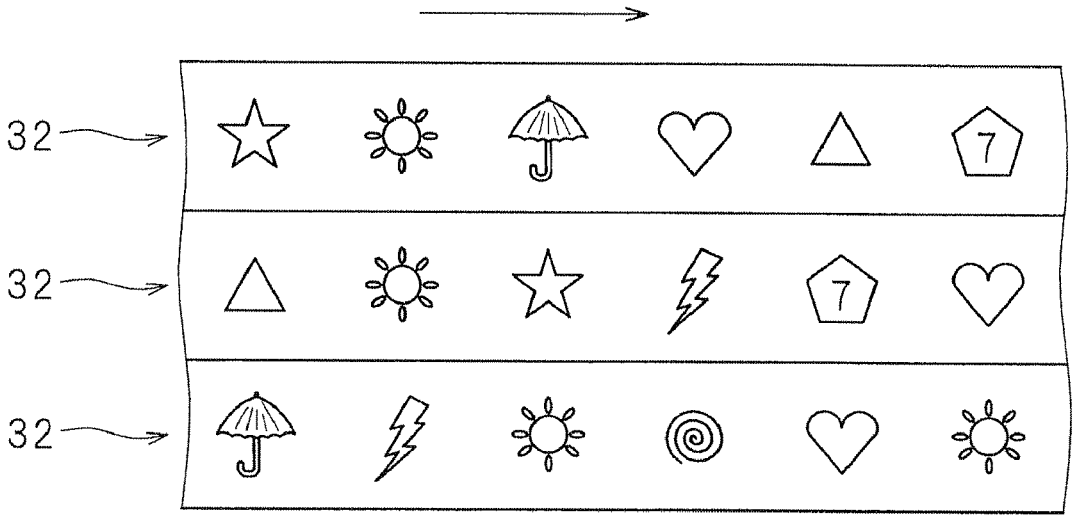
FIG. 4 is a schematic view showing exemplary second video reels displayed on the first liquid crystal display panel included in the gaming machine according to the first embodiment of the present invention.

FIG. 3 is a schematic view showing exemplary first video reels displayed on a first liquid crystal display panel which is included in the gaming machine according to the first embodiment of the present invention. FIG. 4 is a schematic view showing exemplary second video reels displayed on the first liquid crystal display panel which is included in the gaming machine according to the first embodiment of the present invention. Further, like FIG. 1A, FIG. 5 is a schematic view showing an exemplary base game (while each of the reels is displayed in a rotating state) which is displayed on the first liquid crystal display panel included in the gaming machine according to the first embodiment of the present invention, and FIG. 6 is a schematic view showing an exemplary base game (while each of the reels is displayed in a stopped state) which is displayed on the first liquid crystal display panel included in the gaming machine according to the first embodiment of the present invention.

Figure 5:
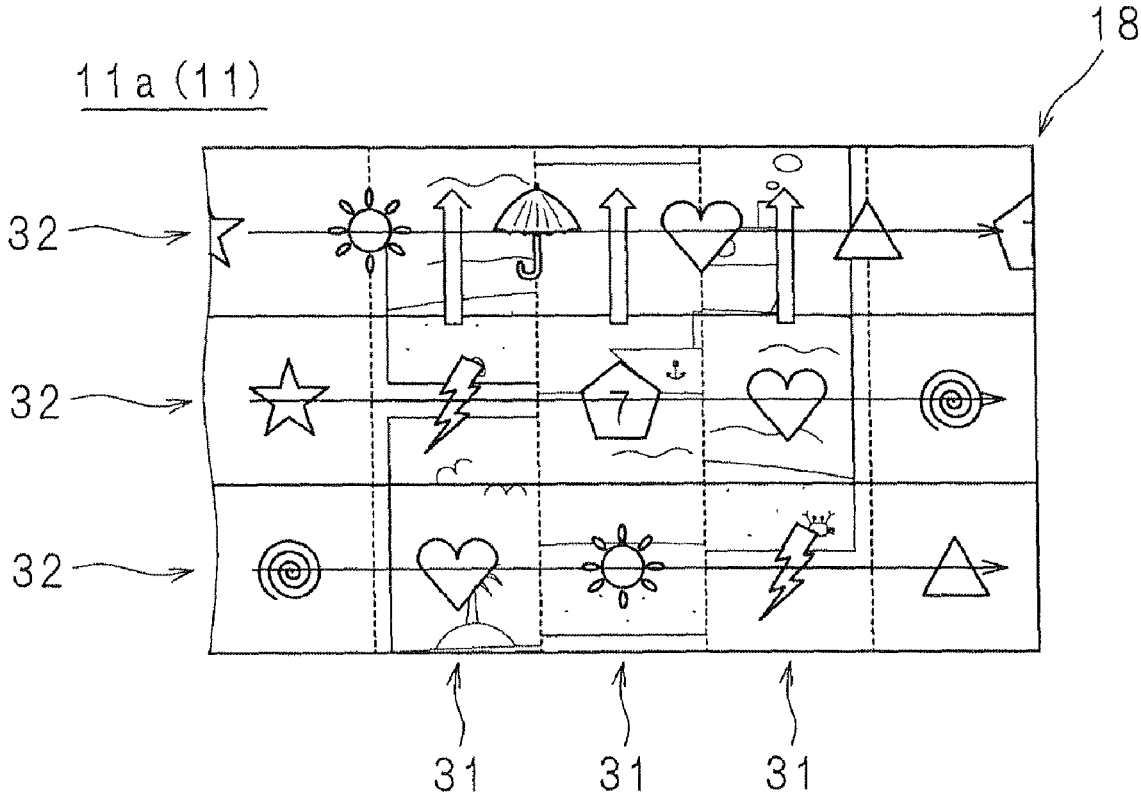
FIG. 5 is a schematic view showing an exemplary base game (while each of the reels are displayed in a rotating state) which is displayed on a first liquid crystal display panel included in the gaming machine according to the first embodiment of the present invention.
Figure 6:
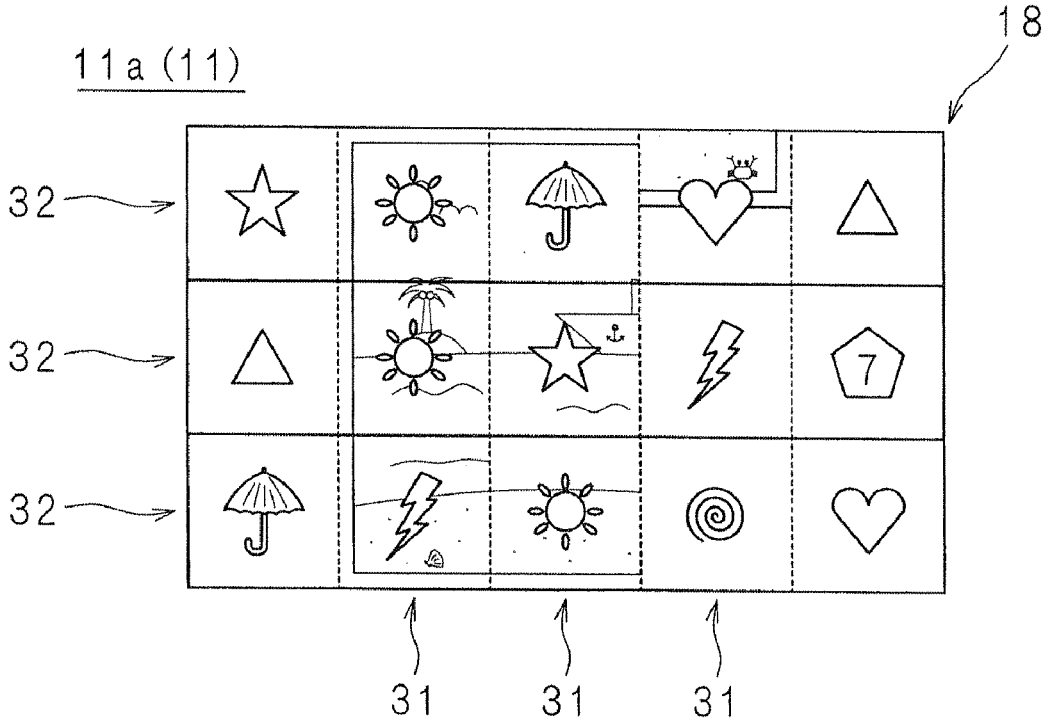
FIG. 6 is a schematic view showing an exemplary base game (while each of the reels are displayed in a stopped state) which is displayed on the first liquid crystal display panel included in the gaming machine according to the first embodiment of the present invention.

As shown in FIGS. 5 and 6, three video reels 31, 31, . . . and three second video reels 32, 32, . . . are displayed, respectively, inside of a display area 11*a* of a first liquid crystal display panel 11. Namely, the gaming machine 1 is a double reel-type gaming machine. Here, let us assume that a square-shaped display unit (hereinafter, simply referred to as a "square") is provided. This square has dimensions in which one symbol, as described later, can be internally arranged. The display area 11*a* has predetermined dimensions equivalent to those of five squares in the horizontal direction and three squares in the vertical direction.

As shown in FIG. 3, each of the first video reels 31 has predetermined dimensions equivalent to those of one square in the horizontal direction. Partial pictures of one entire sheet are arranged on the first video reels 31, 31, . . . . In the present embodiment, this picture is representative of a "beach", and has predetermined dimensions equivalent to those of three squares in the horizontal direction and for three squares in the vertical direction.

Further, one entire sheet is divided into: a partial picture, which constitutes a right side part of this entire sheet; a partial picture, which constitutes a left side part thereof; and a partial picture, which constitutes a center part, and the divided partial pictures are arranged on a right side first video reel 31, a left side first video reel 31, and a middle first video reel 31. Each of the partial pictures has predetermined dimensions equivalent to those of one square in the horizontal direction and equivalent to those of three squares in the vertical direction. In the following description, a partial picture constituting the right side part of the entire sheet is referred to as a right-side partial picture; that constituting the left-side part thereof is referred to as a left-side partial picture; and that constituting the center thereof is referred to as a middle partial picture.

On the right side first video reel 31, a plurality of right partial pictures of one entire sheet, which is representative of a "beach", are arranged while they are adjacent to each other in the vertical direction or while they are spaced from each other at appropriate intervals in the vertical direction. On the left side first video reel 31, similarly, a plurality of left partial pictures of one entire sheet, which is representative of a "beach", are arranged while they are adjacent to each other in the vertical direction or while they are spaced from each other at appropriate intervals in the vertical direction. Further, on the middle first video reel 31, a plurality of middle partial pictures of one entire sheet, which are representative of a "beach", are arranged while they are adjacent to each other in the vertical direction or while they are spaced from each other at appropriate intervals in the vertical direction.

Such first video reels 31, 31, . . . are arranged at the horizontal center part of the display area 11*a*, as shown in FIGS. 5 and 6, and thereafter, are displayed in a rotating state in an upward direction (indicated by the outline arrow in each of FIGS. 3 and 5) in the display area 11*a*. As a result thereof, each of the partial pictures is movably displayed in the upward direction.

As shown in FIG. 4, each of the second video reels 32 has predetermined dimensions equivalent to those of one square in the vertical direction. On each of the second video reels 32, plural types of symbols are arranged at equal intervals in the horizontal direction. In the present embodiment, these symbols are representative of a "star", a "heart", a "whirlpool", a "sun", a "flash of lightning", an "umbrella", and a "triangle" and a picture indicative of a number "7". Such second video reels 32, 32, . . . are arranged entirely in the display area 11*a*, as shown in FIGS. 5 and 6, and are displayed in a rotating state in the rightward direction (indicated by the arrow in each of FIGS. 4 and 5). As a result thereof, each of the symbols is movably displayed in the rightward direction.

Incidentally, in the display area 11*a*, the second video reels 32, 32, . . . are displayed as though they were arranged at the frontal side of the first video reels 31, 31, . . . . In further detail, the first video reels 31, 31, . . . cannot be seen through symbols arranged on each of the second video reels 32, whereas the first video reels 31, 31, . . . and the second video reels 32, 32, . . . are displayed in the display area 11*a* so that the first video reels 31, 31, . . . are seen through portions at which symbols of each of the second video reels 32 are not arranged. As a result thereof, a player can easily visually recognize partial pictures arranged on the first video reels 31, 31, . . . and the symbols arranged on the second video reels 32, 32, 32, . . . .

The symbols arranged on each of the second video reels 32 are made semitransparent, and thereafter, portions at which symbols of each of the second video reels 32 are not arranged are made transparent, whereby the first video reels 31, 31, . . . may be seen through all of the second video reels 32.

In the gaming machine 1, first, a base game is performed. A player performs the base game by operating the operating section 120 shown in FIG. 2 while visually recognizing an image of the base game, which is displayed on the first liquid crystal display panel 11, and an effect image displayed on the second liquid crystal display panel 17.

Where the player operates the start button 12, each of the first video reels 31 is displayed in a rotating state in the upward direction, and each of the second video reels 32 is displayed in a rotating state in the rightward direction, as shown in FIG. 5, in the display area 11*a*. Thus, each of the partial pictures is movably displayed in an upward direction, and each of the symbols is movably displayed in a rightward direction. The first video reels 31, 31, . . . , that have been displayed in a rotating manner, are displayed on a one-by-one reel basis in a stopped state with a predetermined timing. At this time, the partial pictures arranged on each of the first video reels 31 are displayed in a stopped state in the display area 11*a*. As to one of the first video reels 31, however, all of one partial picture may be displayed in the display area 11*a*; part of one partial picture may be displayed therein; or alternatively, each of two partial pictures may be incompletely displayed therein.

As to all of the three first video reels 31, 31, . . . , if all of partial pictures each are fully displayed in the display area 11*a*, one entire sheet completes in the display area 11*a*. If one entire sheet has been completed in the display area 11*a*, a second game, which is different from a base game, is started as described later. Alternatively, as to at least one of the first video reels 31, if all of one partial picture is not displayed in the display area 11*a*, one entire sheet does not complete in the display area 11*a*.

In FIG. 6, there is shown a case in which, on the first video reels 31, 31, . . . , part of the right partial picture, all of the left partial picture, and all of the middle partial picture are displayed in a stopped state in the display area 11*a*. In the display area 11*a* shown in FIG. 6, all of each of the left and middle partial pictures of one entire sheet, which is representative of a "beach", is displayed in a stopped state, whereas only part of the right partial picture is displayed in a stopped state. Therefore, one entire sheet fails to complete.

If one entire sheet does not complete in the display area 11*a*, a base game is continued. At this time, the second video reels 32, 32, . . . , that have been displayed in a rotating state, are displayed on a one-by-one reel basis in a stopped state with a predetermined timing. In FIG. 6, there is shown a case in which, on the second video reels 32, 32, . . . , symbols "7" and "whirlpool" are displayed in a stopped state on a one-by-one basis, "star", "umbrella", "heart", "triangle", and "flash of lightening" are displayed in a stopped state on two-by-two basis, and three "sun" pictures are displayed in a stopped state.

In the present embodiment, where three or more symbols of a same kind are displayed in a stopped state in a display area 11*a*, a winning prize is awarded to a player. At this time, a predetermined number of coins are paid out from the coin tray 14 shown in FIG. 2. Namely, all of the symbols of the present embodiment correspond to scatter symbols. If more than three symbols (i.e. four or more symbols) of a same kind are displayed in a stopped state, more coins may be paid out in proportion thereto. Further, as to plural kinds of symbols, if three or more symbols of a same kind are displayed in a stopped state as well, the number of coins to be paid out may be multiplied. On the other hand, if only two or less symbols of a same kind are displayed in a stopped state in the display area 11*a*, no coin is paid out to the coin tray 14.

Since three "sun" symbols are displayed in the display area 11*a* shown in FIG. 6, coins are given to a player. If one of the three "sun" symbols features a "whirlpool" or a "7", no coin is given to players.

Figure 7:
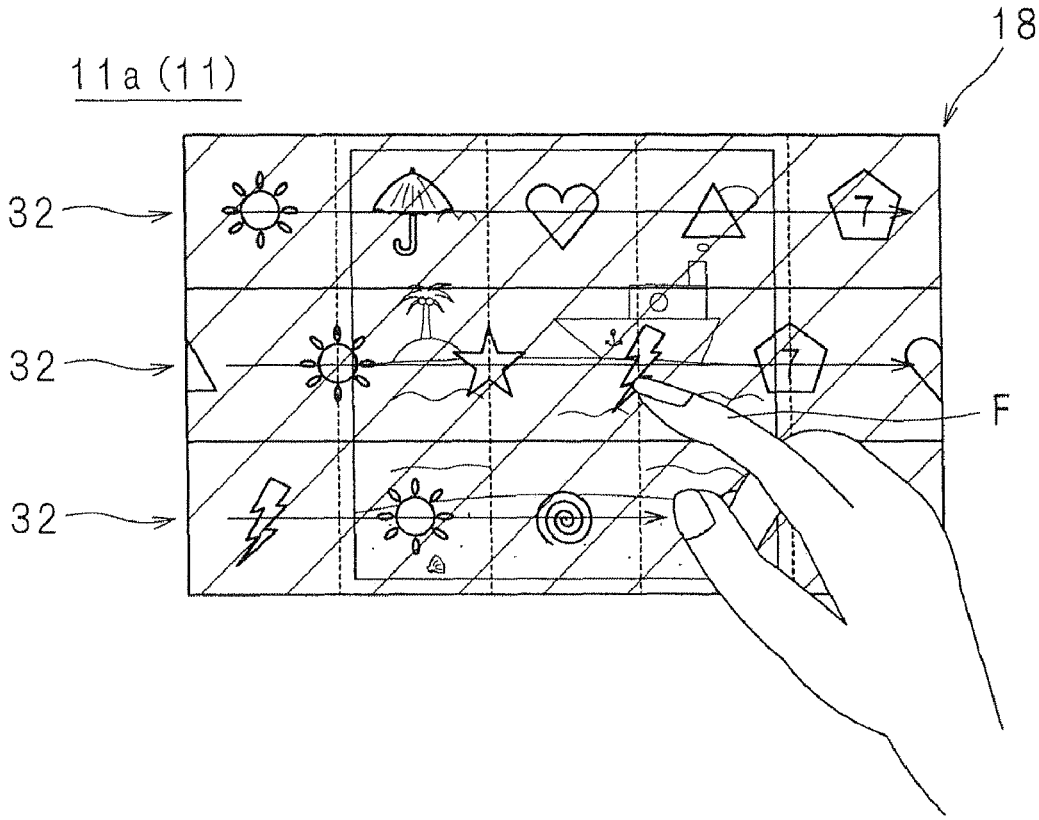
FIG. 7 is a schematic view showing an exemplary second game (while area selection is accepted) which is displayed on the first liquid crystal display panel included in the gaming machine according to the first embodiment of the present invention.
Figure 8:
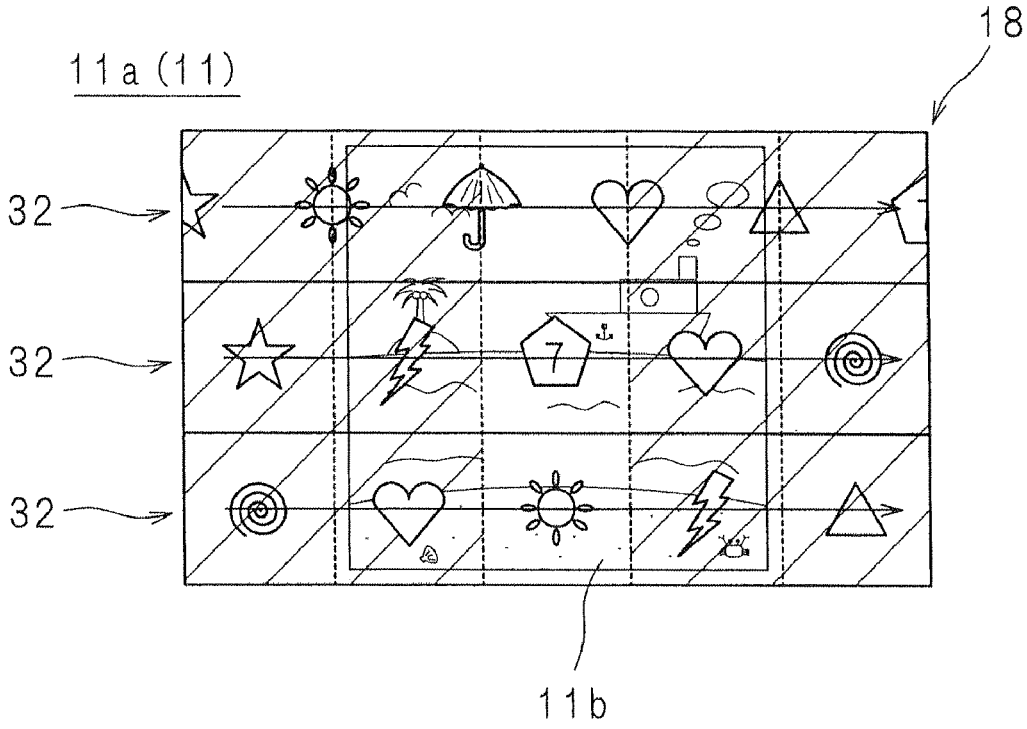
FIG. 8 is a schematic view showing an exemplary second game (while second video reels are displayed in a rotating state) which is displayed on the first liquid crystal display panel included in the gaming machine according to the first embodiment of the present invention.
Figure 9:
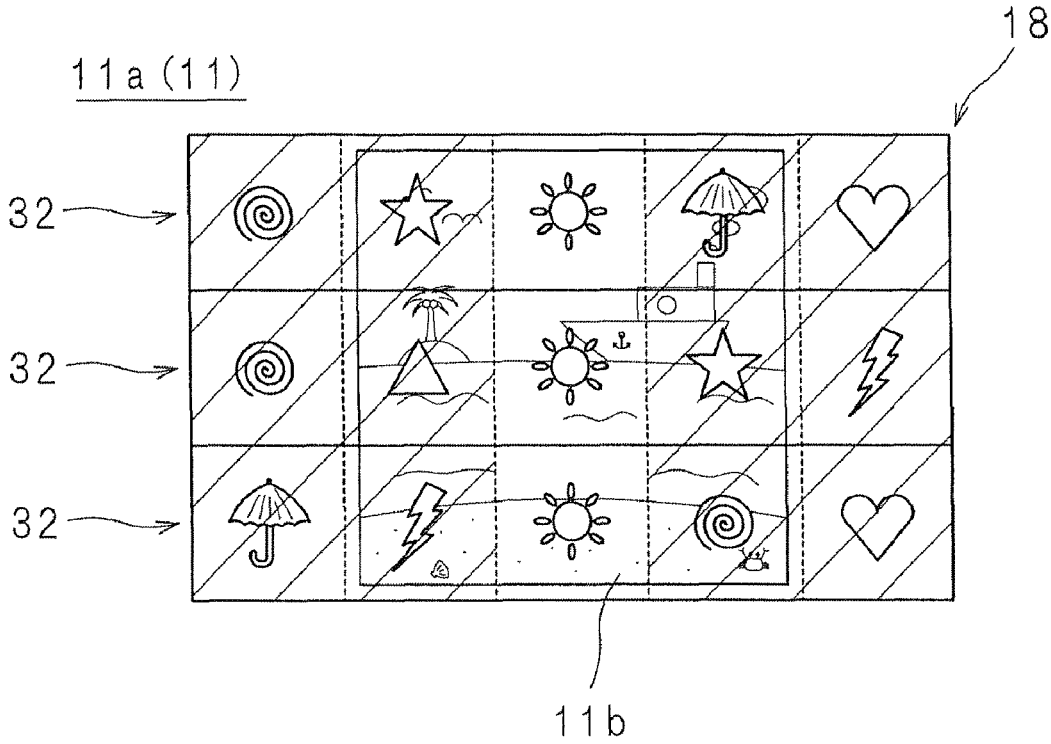
FIG. 9 is a schematic view showing an exemplary second game (while second video reels are displayed in a stopped state) which is displayed on the first liquid crystal display panel included in the gaming machine according to the first embodiment of the present invention.

Like FIG. 1B, FIG. 7 is a schematic view showing an exemplary second game (while area selection is being selected and accepted) which is displayed on the first liquid crystal display panel included in the gaming machine according to the first embodiment of the present invention. FIG. 8 is a schematic view showing an exemplary second game (while the second video reels are displayed in a rotating state) which is displayed on the first liquid crystal display panel included in the gaming machine according to the first embodiment of the present invention. FIG. 9 is a schematic view showing an exemplary second game (while the second video reels are displayed in a stopped state) which is displayed on the first liquid crystal display panel included in the gaming machine according to the first embodiment of the present invention.

If one entire sheet has been completed in the display area 11*a*, a second game is started. Since symbols are used in the second game, the second video reels 32, 32, . . . are displayed in the display area 11*a* even after the second game is started. In order to emphasize the fact that the second game is different from the base game, the colors, shapes, and dimensions, etc., of the symbols may be varied. In FIG. 7, there is shown a case in which, on the first video reels 31, 31, . . . all of partial pictures of one entire sheet, which is representative of a "beach", is displayed in a stopped state in the display area 11*a*. Namely, one entire sheet completes in the display area 11*a* shown in FIG. 7. This means that the second game has started in the display area 11*a* shown in FIG. 7.

While, in the second game of the present embodiment, partial pictures are not directly used, one entire sheet, which has been completed in the base game, is used as a background of a second game image, as shown in FIGS. 7 to 9. Second video reels 32, 32, . . . while in rotation are displayed for a foreground of the second game image. Immediately after the second game has started, the second game images are displayed, as shown in FIG. 7, for both of the foreground and background in a state in which the luminance is lower than that of the base game image. When the second game is started, the completed picture may be deleted without being used as a background, or alternatively, may be used as a background in an unostentatious state by varying a color mode to a monochrome mode or by applying shading, for example.

Although not shown, in a display area other than the display area 11*a* of the first liquid crystal display panel 11, a word or sentence, etc., for prompting a player to select an area to be formed as the activated area 11*b* (as shown in FIGS. 8 and 9) is displayed by touching the screen with one's finger F. At this time, the player operates the touch panel 18 with one's finger F, as shown in FIG. 7, and selects an area to be formed as the activated area 11*b*.

The activated area 11*b* of the present embodiment is a vertically band-shaped area indicative of a site touched by the player's finger F. In more detail, the activated area 11*b* has predetermined dimensions equivalent to those of one square in the horizontal direction and for three squares in the vertical direction. Therefore, five candidates for the area to be formed as the activated area 11*b* exist in the display area 11*a*.

If the touch panel 18 accepts an area selection, the activated area 11*b* is determined to be formed as that accepted by the touch panel 18, in the display area 11*a* of the first liquid crystal display panel 11. At this time, the determined activated area 11*b*, as shown in FIG. 8, is displayed on the first liquid crystal display panel 11 in a state in which the luminance of this activated area 11*b* is higher than that of the display area 11*a* other than this activated area 11*b*. Lastly, the second video reels 32, 32, . . . , that have been displayed in a rotating state, are displayed in a stopped manner on a one-by-one reel basis with a predetermined timing. At this time, the symbols of each of the second video reels 32 stop at the determined layout positions. Further, if specific symbols have stopped in the activated area 11*b*, the prize corresponding to the specific symbols is established.

In the present embodiment, as shown in FIG. 9, if three symbols of a same kind are displayed in a stopped state in the activated area 11*b*, a prize is awarded to a player. At this time, a predetermined number of coins are paid out from the coin tray 14 shown in FIG. 2. On the other hand, if two or less symbols of a same kind are displayed in a stopped state in the activated area 11*b*, no coin is paid out to the coin tray 14. Three "sun" symbols are displayed in the activated area 11*b* shown in FIG. 9, and thus, coins are given to players. Incidentally, while a "sun" symbol is displayed in the display area 11*a* other than the activated area 11*b* as well, this does not influence how many coins are to be awarded. Further, while three "whirlpool" symbols are displayed in the display area 11*a* other than the activated area 11*b*, this does not lead to coin payout.

The activated area 11*b* may be formed in a band shape having predetermined dimensions equivalent to those of a plurality of squares in the horizontal direction and for one square in the vertical direction. In this case, a prize may be established when one or more predetermined symbols are displayed in a stopped state in the activated area 11*b*. Further, the activated area 11*b* may be formed in a rectangular shape having predetermined dimensions equivalent to those of one square in each of the vertical and horizontal directions. In this case, for example, after a player is prompted to select N activated areas 11*b*, 11*b*, . . . (where N is a natural number), if M or more symbols (where M is a natural number less than or equal to N) are displayed in a stopped state, a prize may be established. Further, the established prize may be awarded to a player after it has been conveniently accumulated, without being awarded to the player immediately.

Furthermore, after each of the second video reels 32 are displayed in a stopped state, each of the second video reels 32 may be displayed again in a rotating state automatically or according to the player's operation of the start button 12 or the touch panel 18. At this time, after each of the second video reels 32 has been displayed again in a stopped state, if specific symbols have stopped in the activated area 11*b*, the prize corresponding to the specific symbols is established. Namely, the second game is executed a plurality of times. If the second game is executed a plurality of times, of course, the layout positions of symbols are randomly determined.

Such rotational redisplay and stopped redisplay of each of the second video reels 32 may be executed only when a player has won a prize, or alternatively, may be executed only when a player has not won a prize. Further, it may be executed irrespective of whether or not a prize is established. At the time of rotational redisplay, a fresh selection of the activated area 11*b* may be further accepted, or alternatively, the activated area 11*b* that was already selected may be reused.

A feature game may be started instead of a prize or at the same time as when a prize is established. Alternatively, the feature game may be started regardless whether or not a prize is established.

FIG. 10 is a block diagram depicting a configuration of essential portions of the gaming machine according to the first embodiment of the present invention. The gaming machine 1 has a plurality of constituent elements, chiefly a main control board 2 containing a main microcomputer 200.

In addition to the main microcomputer 200, the main control board 2 has a random number establishing circuit 23, a sampling circuit 24, an I/O port 25, a hopper driving circuit 142, and a lamp driving circuit 161. To the I/O port 25, an operating section 120, a coin detecting section 131, a hopper driving section 142, a lamp driving section 161, a touch panel 18, and a sub-control board 4 are connected. To the sub-control board 4, speakers 15, 15 and liquid crystal display panels 11, 17 are connected. To the hopper driving circuit 142, a hopper 141 is connected. To the lamp driving circuit 161, decorative lamps 16, 16, . . . are connected.

The main microcomputer 200 has a main CPU 20, a ROM 21, and a RAM 22. To the main CPU 20, the ROM 21, the RAM 22, the random number establishing circuit 23, the sampling circuit 24, and the I/O port 25 are connected. To the random number establishing circuit 23, the sampling circuit 24 is connected. The ROM 21 stores computer programs (hereinafter, simply referred to as "programs") and permanent data used when executing the programs.

The data stored in the ROM 21 includes a partial picture table, a prize table for second game, a random number table for partial image, a symbol table, a prize table for base game, and a random number table for symbols, for example. The partial picture table stores: individual first reel identification information provided to each of the first video reels 31; and partial-picture identification information related to respective partial pictures arranged on each of the first video reels 31.

In the prize table for second game, the prizes awarded to players are stored when specific partial pictures are displayed in a stopped state in the activated area 11*b*. Specifically, in the prize table, prizes are awarded to players if three partial pictures of a same kind are displayed in a stopped state in the activated area 11*b*, and further, various data are stored so that the numbers of prizes corresponding to partial pictures of different kinds (i.e., the number of coins) are different from one another. In the random number table for partial image, the ranges of random numbers and probabilities that one entire sheet completes (i.e., probabilities of starting a second game) are stored in association with one another. The symbol table stores: individual second reel identification information assigned to the second video reels 32; and symbol identification information related to symbols arranged on the second video reels 32.

The prize table for base game stores prizes awarded to players if specific symbols are displayed in a stopped state in the display area 11*a*. Specifically, the prize table stores various types of data so that, if three or more symbols of a same kind are displayed in a stopped state in the display area 11*a*, prizes are awarded to players, and the numbers of prizes corresponding to symbols of different kinds (i.e., the number of coins) are different from each other. In the random number table for symbols, for specific symbols for awarding the prizes to the players, the ranges of random numbers and winning probabilities (i.e., probabilities of awarding prizes to players) are stored in association with one another. For example, the random number table stores various types of data so as to narrow the range of random numbers and lower the winning probabilities with respect to symbols allowed to award a large amount of prize money (i.e., a large number of coins) to the players.

The main CPU 20 executes various types of processes in accordance with the programs and data stored in the ROM 21. Specifically, the main CPU 20 controls the entire equipment operation of the gaming machine 1 by inputting/outputting signals to/from other constituent elements directly or via the I/O port 25. The random number generating circuit 23 is controlled and actuated by means of the main CPU 20, and generates a predetermined range of random numbers. The sampling circuit 24 is controlled and actuated by means of the main CPU 20, samples any of the random number generated by the random number generating circuit 23, and inputs the sampled random numbers to the main CPU 20.

The RAM 22 temporarily stores the data and programs used when the main CPU 20 is actuated. For example, the RAM 22 stores the random numbers sampled by means of the sampling circuit 24. In addition, the RAM 22 stores: first-reel identification information relating to each of three first video reels 31, 31, . . . ; partial-picture identification information related to the partial pictures which should stop in the display area 11*a* with respect to each of the first video reels 31; and layout position information in the vertical direction of the partial pictures that should stop in the display area 11*a*. Further, the RAM 22 stores: second-reel identification information for each of three second video reels 32, 32, . . . ; symbol identification information related to symbols which should stop in the display area 11*a* with respect to the second video reels 32; and layout position information in the horizontal direction of the symbols that should stop in the display area 11*a*.

The lamp driving circuit 161 outputs to decorative lamps 16, 16, . . . , effects signals for causing the decorative lamps 16, 16, . . . to perform an illumination effect under the control of the main CPU 20. The decorative lamps 16, 16, . . . , to which the effect signals have been input, light or blink. The hopper driving circuit 142 drives the hopper 141 under the control of the main CPU 20. As a result thereof, the hopper 141 pays out a predetermined number of coins to the coin tray 14. The coin detecting section 131 detects a coin inserted into the coin insertion slot 13, and then, outputs a coin detection signal, indicating a detection result, to the main CPU 20 via the I/O port 25. The main CPU 20 computes the number of coins inserted into the coin insertion slot 13, based upon the input coin detection signal.

From the operating section 120, at which various types of operational buttons including the start button 12 are operated, operating signals corresponding to the operated operational buttons are output to the main CPU 20 via the I/O port 25. The main CPU 20 controls equipment operation of the gaming machine 1 in response to the inputted operational signals. For example, where the start button 12 is operated, the start signal corresponding to the start button 12 is output to the main CPU 20. The main CPU 20, to which the start signal has been input, starts displaying the first video reels 31 in a rotating state and displaying the second video reels 32 in a rotating state, via the sub-control board 4 described later.

The touch panel 18 is a pressure-sensitive input device. To be more precise, the touch panel 18 specifies the coordinate position of a site touched by a player, and then, outputs a positional signal indicating the specified coordinate position, to the main CPU 20 via the I/O port 25.

The main CPU 20 indirectly controls speakers 15, 15 and liquid crystal display panels 11, 17 by controlling a sub-CPU 40 (see FIG. 11), included in the sub-control board 4. As a result thereof, an effect voice or a melodious sound etc. is output from the speakers 15, 15, and, the liquid crystal display panels 11, 17 display various types of images. Thus, a predetermined control signal is output from the main CPU 20 to the sub-CPU 40, via the I/O port 25 and the IN port 43 (see FIG. 11).

Figure 11:
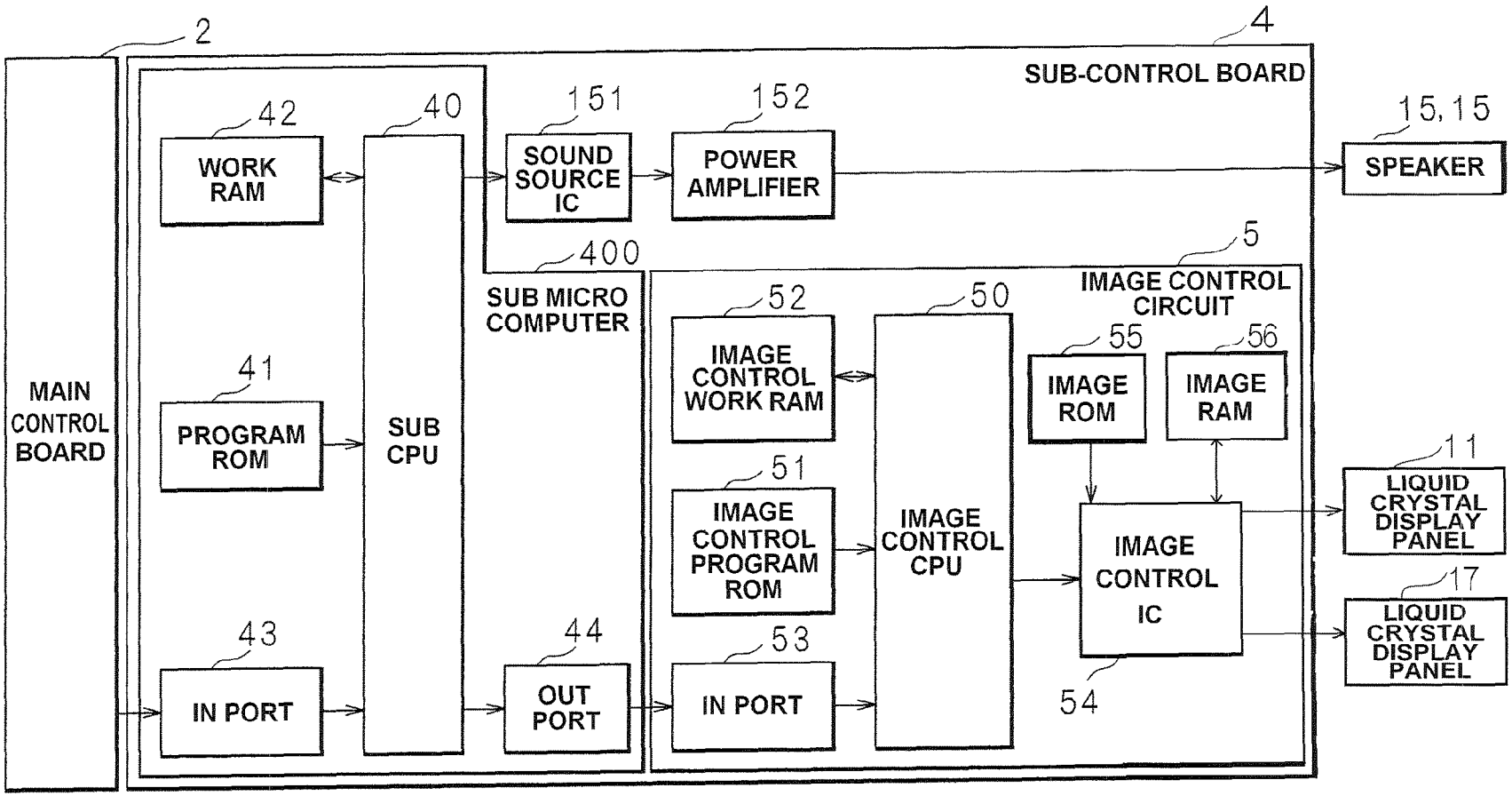
FIG. 11 is a block diagram depicting a configuration of essential portions of a sub-control board included in the gaming machine according to the first embodiment of the present invention.

FIG. 11 is a block diagram depicting a configuration of essential portions of a sub-control board included in the gaming machine according to the first embodiment of the present invention. In the sub-control board 4, a control signal is input from the main control board 2, thereby executing display control of each of the liquid crystal display panels 11, 17 and voice output control of the speakers 15, 15. The sub-control board 4 is a circuit board, which is different from that which constitutes the main control board 2, and consists essentially of a sub-microcomputer 400.

First, connection statuses of constituent elements will be described. The sub-microcomputer 400 has a sub CPU 40, a program ROM 41, a work RAM 42, an IN port 43, and an OUT port 44. To the sub CPU 40, the program ROM 41, the work RAM 42, the IN port 43, and the OUT port 44 are connected. The OUT port 44 is connected to an IN port 53 of an image control circuit 5 described later. The IN port 43 is connected to the I/O port 25 of the main control board 2 (see FIG. 10).

The sub-control board 4, shown in FIG. 11, has a sound source IC 151, a power amplifier 152, and an image control circuit 5, in addition to the sub-computer 400. The sound source IC 151 is connected to the sub CPU 40, and the power amplifier 152 is connected to the sound source IC 151 and the speakers 15, 15. An image control circuit 5 has: an image control CPU 50; an image control program ROM 51; an image control work RAM 52; an IN port 53; an image control IC 54; an image ROM 55; and an image RAM 56. The image control CPU 50 is connected to the image control program ROM 55, the image control work RAM 52, the IN port 53, and the image control IC 54. To the image control IC 54, the image ROM 55 and the image RAM 56 are connected. Further, to the image control IC 54, the liquid crystal display panels 11 and 17 are connected.

Next, functions of constituent elements will be described. The program ROM 41 stores: the programs for actuating the sub CPU 40; and permanent data used when executing the programs. The sub-control board 4 is not provided with a random number generating circuit and a sampling circuit, and instead, the program ROM 41 stores random sampling programs thereof.

The sub CPU 40 executes various types of processes in accordance with the programs and data stored in the program ROM 41, based upon a control signal input from the main control board 2. Specifically, the sub CPU 40 controls operations of the speakers and liquid crystal display panels 11, 17, etc., by inputting/outputting signals from/to other constituent elements, directly or via the IN port 43 or OUT port 44. In addition, the sub CPU 40 executes random number sampling programs, thereby generating random numbers and sampling the generated random numbers. Further, the sub CPU 40 computes image display parameters, and then, outputs to the image control CPU 50 the parametric signals which are indicative of the computed parameters.

The work RAM 42 temporarily stores the data and programs used when the sub CPU 40 is actuated. For example, the work RAM 42 stores the random numbers sampled by the sub CPU 40 executing the random number sampling programs. The sound source IC 151 is controlled by means of the sub CPU 40, and outputs an effect sound from the speakers 15, 15. The power amplifier 152 is an amplifier for amplifying the voice output from the speakers 15, 15.

The image control program ROM 51 of the image control circuit 5 stores image control programs and permanent data that is used at the time of executing the image control programs. The permanent data is a determination table for determining the images to be displayed on the liquid crystal display panels 11, 17, for example. The imaging ROM 55 stores data of base game images using dot data, data of the second game images and data, or the like, of effect images, respectively.

The image control CPU 50 determines the contents of images to be displayed on the liquid crystal display panels 11, 17, in accordance with the image control programs and data that have been stored in the image control program ROM 51. This determination is based upon the parameter signals input from the sub-microcomputer 400. The image control work RAM 52 temporarily stores the data and programs used when the image control CPU 50 is actuated.

The image control IC 54 reads image data from the image ROM 55 in accordance with the contents determined by the image control CPU 50, and forms video images, based upon the read data. Then, this IC outputs the resultant images to the liquid crystal display panels 11, 17. The liquid crystal display panels 11, 17 are for displaying the input video images. The image RAM 56 temporarily stores data used when the image control IC 54 is actuated. In further detail, in the image RAM 56, a memory area for storing data for displaying the first video reels 31 and a memory area for storing data for displaying the second video reels 32 are provided. The image control IC 54 forms video images by superimposing data read from each of the memory areas, and then, outputs the resultant images to the liquid crystal display panels 11, 17.

In this manner, the main CPU 20 causes the liquid crystal display panels 11, 17 to display required images via the sub CPU 40, the image control CPU 50, and the image control IC 54. Therefore, the burden of the main CPU 20 can be alleviated more remarkably than that exerted in a case in which the main CPU 20 directly controls the liquid crystal display panels 11, 17 to display required images.

[1-3. Operation of the Gaming Machine]

Figure 12:
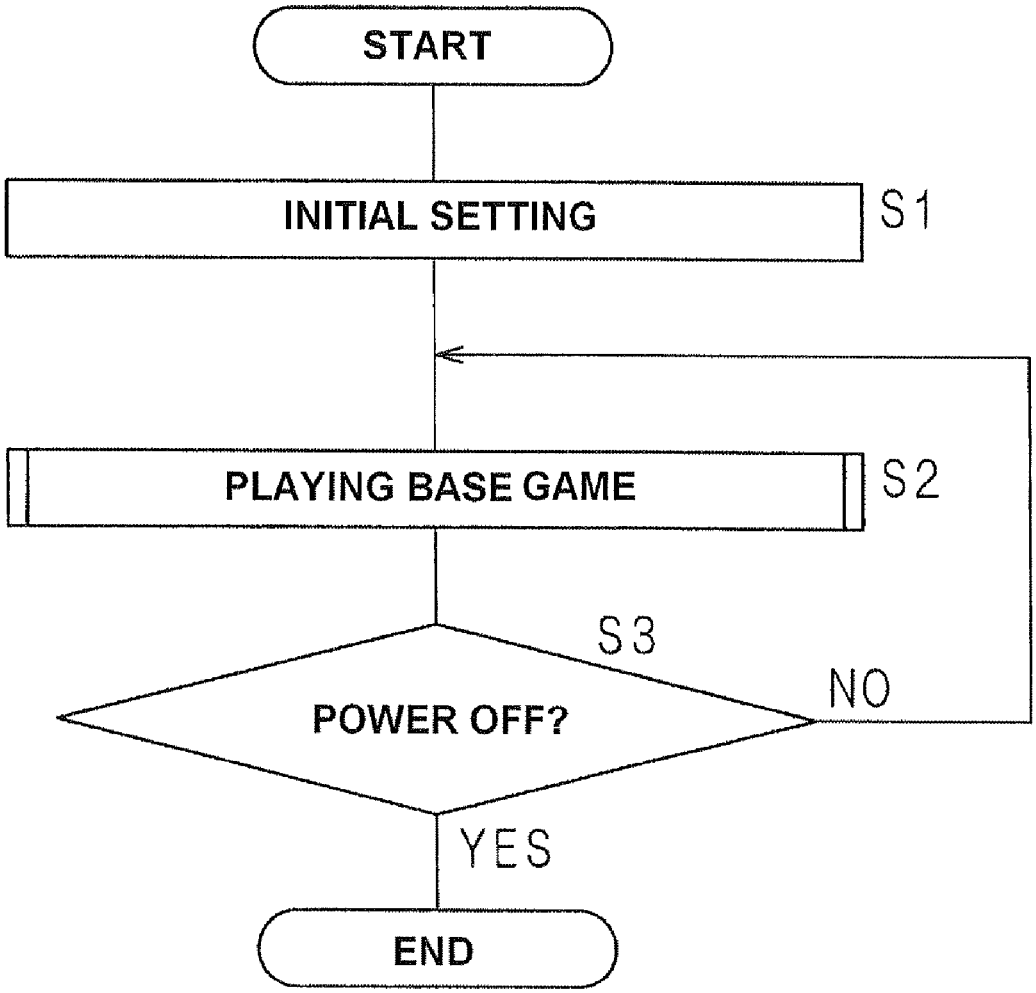
FIG. 12 is a flowchart showing procedures for executing game control processing in the gaming machine according to the first embodiment of the present invention.

FIG. 12 is a flowchart showing procedures for executing game control processing in the gaming machine according to the first embodiment of the present invention. If a power switch (not shown) of the gaming machine 1 is turned ON, whereby power is supplied to the gaming machine 1, the main microcomputer 200 is activated, and thereafter, the main CPU 20 provides initial setting (Step 1. Hereinafter, the step is referred to as "S").

The main CPU 20 at S1 executes a BIOS stored in the ROM 21, and then, decompresses in the RAM 22 the compressed data incorporated in the BIOS. After that, this CPU executes the BIOS decompressed in the RAM 22, and diagnoses and initializes various types of peripherals. The main CPU 20 causes the RAM 22 to store the program and data stored in the ROM 21. In addition, this CPU controls the decorative lamps 16, 16, . . . via the lamp driving circuit 161, and then, starts an illumination effect. Further, this CPU controls speakers 15, 15 via the sub-control board 4, and then, starts a voice effect. Furthermore, the main CPU 20 controls the liquid crystal display panels 11, 17 via the sub-control board 4 to display predetermined images.

Then, the main CPU 20 invokes a subroutine of a base game playing process (see FIGS. 13A and 13B), and then, executes processing (S2). After completion of the process at S2, the main CPU 20 judges whether or not the power switch is turned OFF (S3). If the power switch is left to be ON (NO at S3), the process at S2 is repeatedly executed. If the power switch is turned OFF (YES at S3), the main CPU 20 controls constituent elements of the gaming machine 1, terminates various types of operations (such as illumination and voice effect rendering and image displaying), and then, terminates game control processing.

Figure 13A:
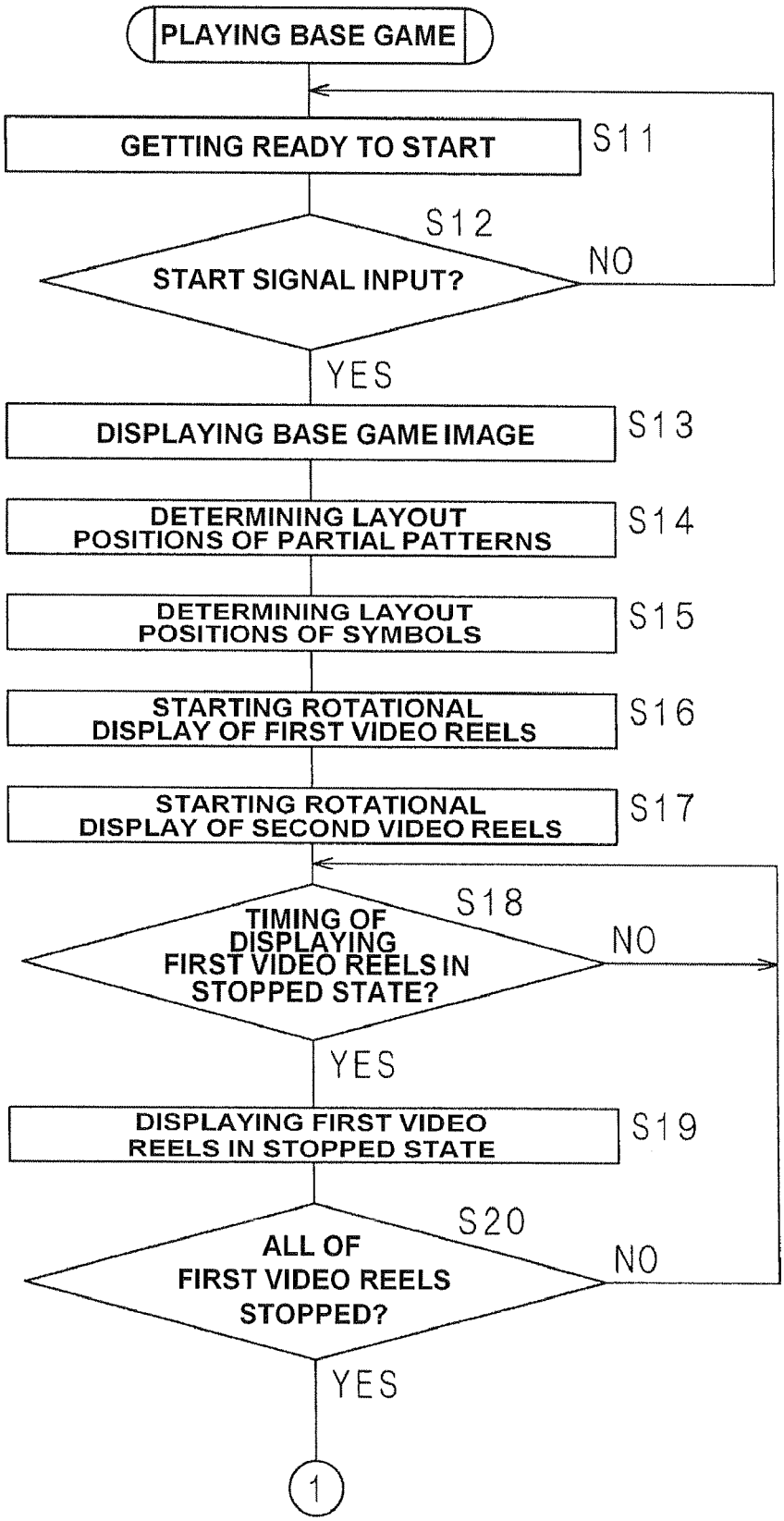
FIGS. 13A and 13B are flowcharts each showing a subroutine of procedures for executing a base game playing process at a game machine according to the first embodiment of the present invention.
Figure 13B:
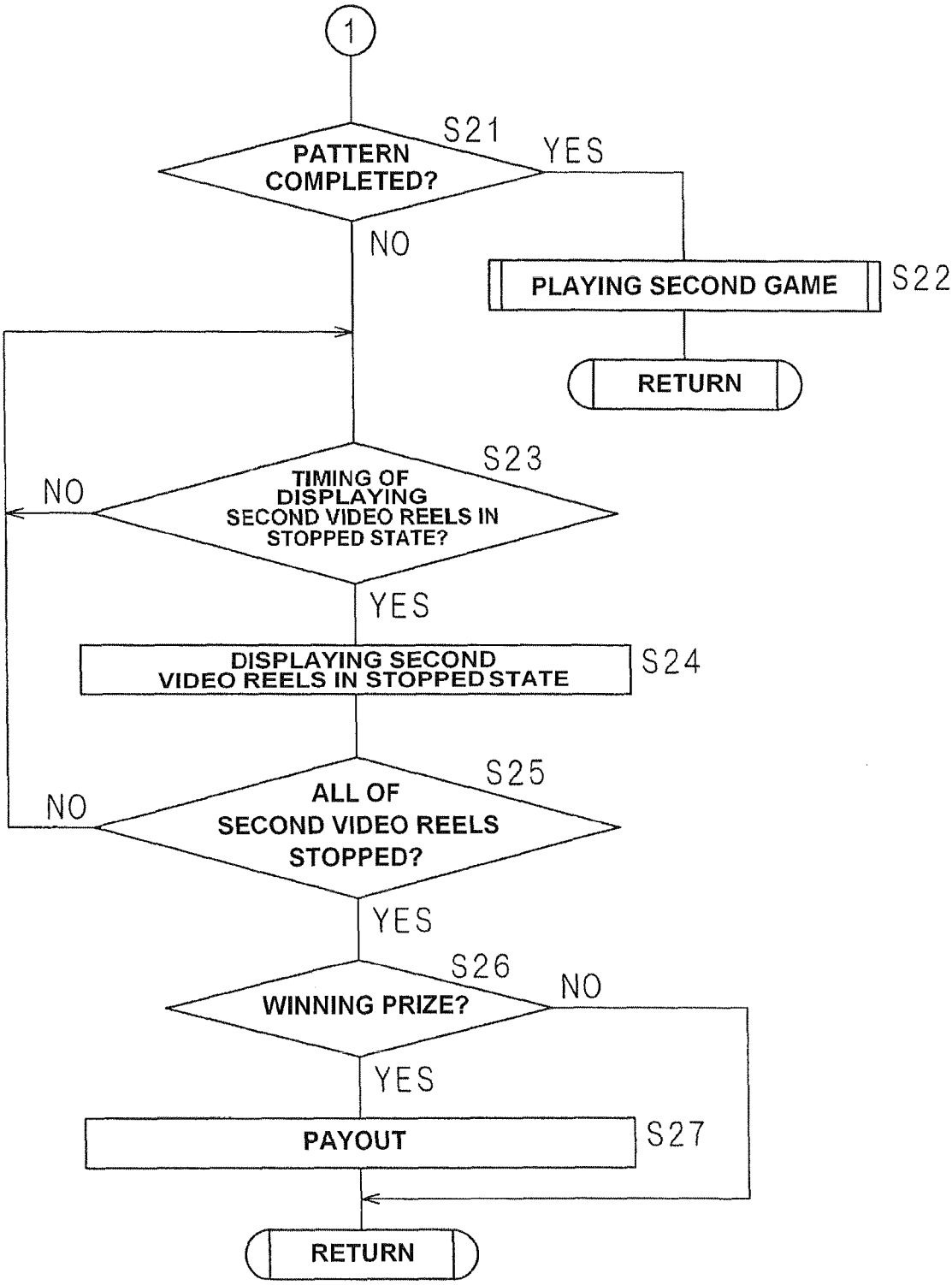

FIGS. 13A and 13B are flowcharts each showing a subroutine of procedures for executing a base game playing process at the gaming machine according to the first embodiment of the present invention. The main CPU 20 accepts getting ready to start a game (S11). Where the process at S11 is executed, a player is ready to start a game by inserting a coin into the coin insertion slot 13, and thereafter, operating the operating section 120 (for example, increasing or decreasing BET by operating a BET button). After that, the player operates the start button 12.

Thus, although not shown, the main CPU 20 at S11 computes the number of coins inserted into the coin insertion slot 13, based upon a coin detection signal input from a coin detecting section 131, and then, causes a RAM 22 to store the result of computation in a RAM 22. Further, this CPU causes the RAM 22 to store a value of BET increased or decreased by operating the operating section 120.

Next, the main CPU 20 judges whether or not a start signal is input from the operating section 120 (S12). The judgment at S12 is made as to whether or not the start button 12 has accepted operation. Where the start signal is not input yet (NO at S12), the main CPU 20 reverts to S11, and then, continuously accepts getting ready to start a game. Where the start signal is input from the operating section 120 (YES at S12), i.e., where the start button 12 accepts operation, although not shown, the main CPU 20 computes the number of coins accumulated in the gaming machine 1 by subtracting the value of BET from the number of coins stored in a RAM 22. Then, the routine proceeds to S13.

Although not shown, the main CPU 20 starts a base game, thereby causing a display area 11*a* of a first liquid crystal display panel 11 (S13) to display a base game image and a second liquid crystal display panel 17 to display an effect image. After the process at S13 is executed, the base game image displayed in the display area 11*a*, as shown in FIG. 6, for example, is formed indicating that the first video reels 31 and the second video reels 32 have stopped. The main CPU 20 at S13 outputs to a sub CPU 40 a control signal which is indicative of the fact that a base game is started at the gaming machine 1. The sub CPU 40, to which this control signal has been input from the main CPU 20, outputs to an image control CPU 50 a parameter signal for causing the first liquid crystal display panel 11 to display a base game image.

The image control CPU 50, to which this parameter signal has been input, determines the contents of a base game image to be actually displayed on the first liquid crystal display panel 11. Further, this CPU outputs to an image control IC 54 a determination signal which is indicative of the determined contents. The image control IC 54, to which this determination signal has been input, reads from an image ROM 55, data of the base game image which is responsive to the input determination signal. Further, this control IC forms the read image, based upon the read data, and then, outputs the resulting image to the first liquid crystal display panel 11. As a result thereof, the first liquid crystal display panel 11 displays the base game image. Similarly, the second liquid crystal display panel 17 displays an effect image.

Next, the main CPU 20 randomly determines layout positions of partial pictures in correspondence with the first video reels 31 (S 14), and randomly determines layout positions of symbols in correspondence with the second video reels 32 (S15). The layout positions of the partial pictures determined at S14 correspond to vertical layout positions of partial pictures to be displayed in a stopped state in the display area 11*a* if the first video reels 31 are displayed in a stopped state. In order to determine partial pictures at S14, the main CPU 20 references tables such as a partial-picture table and a random number table for partial images, which have been stored in the ROM 21, and then, employs the random numbers that have been generated by the random number generating circuit 23 and sampled by the sampling circuit 24. The RAM 22 temporarily stores symbol identification information and layout position information related to the determined symbols in association with the second reel identification information related to the first video reels 31.

The layout positions of the symbols determined at S15 correspond to horizontal layout positions of symbols to be displayed in a stopped state in the display area 11*a* when the second video reels 32 are displayed in a stopped state. In order to determine symbols at S15, the main CPU 20 references the symbol table and the random number table for symbols that have been stored in the ROM 21, and employs the random numbers that have been generated by the random number generating circuit 23 and sampled by the sampling circuit 24.

The RAM 22 temporarily stores the symbol identification information and layout position information related to the determined symbols in association with the second reel identification information related to the second video reels 32.

After completion of the process at S15, the main CPU 20 starts rotational display of the first video reels 31 (S16), and starts rotational display of the second video reels 32 (S17). Thus, the main CPU 20 at S16 and S17 outputs an appropriate control signal to a sub CPU 40, thereby starting rotational display of each of the first video reels 31 via an image control CPU 50 and an image control IC 54, and thereafter, starting rotational display of each of the second video reels 32.

The base game image displayed in the display area 11*a* after the process at S16 and S17 is executed is indicative of the fact that the first and second video reels 31 and 32 are rotating, as shown in FIG. 5, for example. Incidentally, an elapsed time from execution of the process at S13 to execution of the processes at S16 and S17 is sufficiently short, so that players can see this image, as if the first video reels 31 and the second video reels 32 started rotating immediately after operating the start button 12.

Further, the main CPU 20 judges whether or not a timing with which the first video reels 31 is to be displayed in a stopped state is established, based upon an elapsed time after starting rotational display of the first video reels 31 (S18). If this timing is not established (NO at S18), the main CPU 20 repeats the judgment made at S18 while continuing rotational display of the first video reels 31. An elapsed time after starting rotational display of the first video reels 31 may be clocked using a timer (not shown), or alternatively, may be clocked by counting the number of clocks input from a clock generator (not shown) to the main CPU 20.

With respect to at least one of the first video reels 31, a timing with which the first video reel 31 is to be displayed in a stopped state is established (YES at S18), the main CPU 20 causes the first video reels 31 to be displayed in a stopped state so that the partial picture determined at S14 with respect to the first video reel 31 (to be displayed in a stopped state) stops at the layout position determined at S14 (S19). Thus, the main CPU 20 at S19 outputs an appropriate control signal to the sub CPU 40 in accordance with the first reel identification information, partial-picture identification information, and layout position information stored in the RAM 22, thereby displaying the first video reel 31 in a stopped state, via the image control CPU 50 and the image control IC 54.

After the completion of the process at S19, the main CPU 20 judges whether or not all of the three first video reels 31, 31, . . . have been stopped (S20). If at least one of the first video reels 31 is still displayed in a rotating state (NO at S20), this CPU controls the routine revert to S18 and judges a timing of stopping rotation of such video reel in action. If all of the three first video reels 31, 31, . . . have been displayed in a stopped state (YES at S20), the main CPU 20 judges whether or not a picture has been completed (S21). Thus, the main CPU 20 references partial-picture identification information and layout position information, which have been stored in the RAM 22, and then, judges whether or not all of partial pictures displayed in a stopped state in the display area 11*a* are displayed in a stopped state in the display area 11*a*.

If one entire sheet has been completed (YES at S21), the main CPU 20 invokes a subroutine of a second game playing process (see FIG. 14), and then, executes processing (S22). After the completion of the process at S22, the main CPU 20 terminates a base game playing process, and then, reverts to the former routine.

On the other hand, if one entire sheet is incomplete (NO at S21), the main CPU 20 judges whether or not a timing with which the second video reels 32 is to be displayed in a stopped state is established, based upon an elapsed time after starting rotational display of the second video reels 32 (S23). If this timing is not established (NO at S23), the main CPU 20 repeats the judgment made at S23 while continuing rotational display of the second video reels 32. An elapsed time after starting rotational display of the second video reels 32 may be clocked using a timer (not shown), or alternatively, may be clocked by counting the number of clocks input from a clock generator (not shown) to the main CPU 20.

As to at least one of the second video reels 32, if a timing with which the second video reel 32 is to be displayed in a stopped state is established (YES at S23), the main CPU 20 causes the second video reels 32 to be displayed in a stopped state so that the partial picture determined at S15 with respect to the second video reel 32, to be displayed in a stopped state, stops at the layout position determined at S15 (S24). Thus, the main CPU 20 at S24 outputs an appropriate control signal to the sub CPU 40 in accordance with the second reel identification information, the partial-picture identification information, and the layout position information, all items of which have been stored in the RAM 22, thereby displaying the second video reel 32 in a stopped state, via the image control CPU 50 and the image control IC 54.

After the completion of the process at S24, the main CPU 220 judges whether or not all of the three second video reels 32, 32, . . . , have been stopped (S25). If at least one of the second video reels 32 is still displayed in a rotating state (NO at S25), this CPU controls the routine to revert to S23 and judges a timing of stopping rotation of such video reel.

Where all of the three second video reels 32, 32, . . . , have been stopped (YES at S25), the main CPU 20 judges whether or not a winning prize is established (S26). Thus, the main CPU 20 references tables such as the symbol table and prize table for base game stored in the ROM 21 and the second reel identification information and symbol identification information stored in the RAM 22, and then, judges whether or not specific symbols stop in the display area 11*a*. In further detail, this CPU judges whether or not at least three of the symbols of a same kind are displayed in a stopped state in the display area 11*a*.

Where a winning prize is established (YES at S26), the main CPU 20 controls a hopper 141 via a hopper driving circuit 142 to pay out a predetermined number of coins (S27), and then, terminates the base game playing process. After that, this CPU reverts to the former routine. If no winning prize is established (NO at S26), the main CPU 20 terminates the base game playing process without executing the process at S27, and then, reverts to the former routine.

Figure 14:
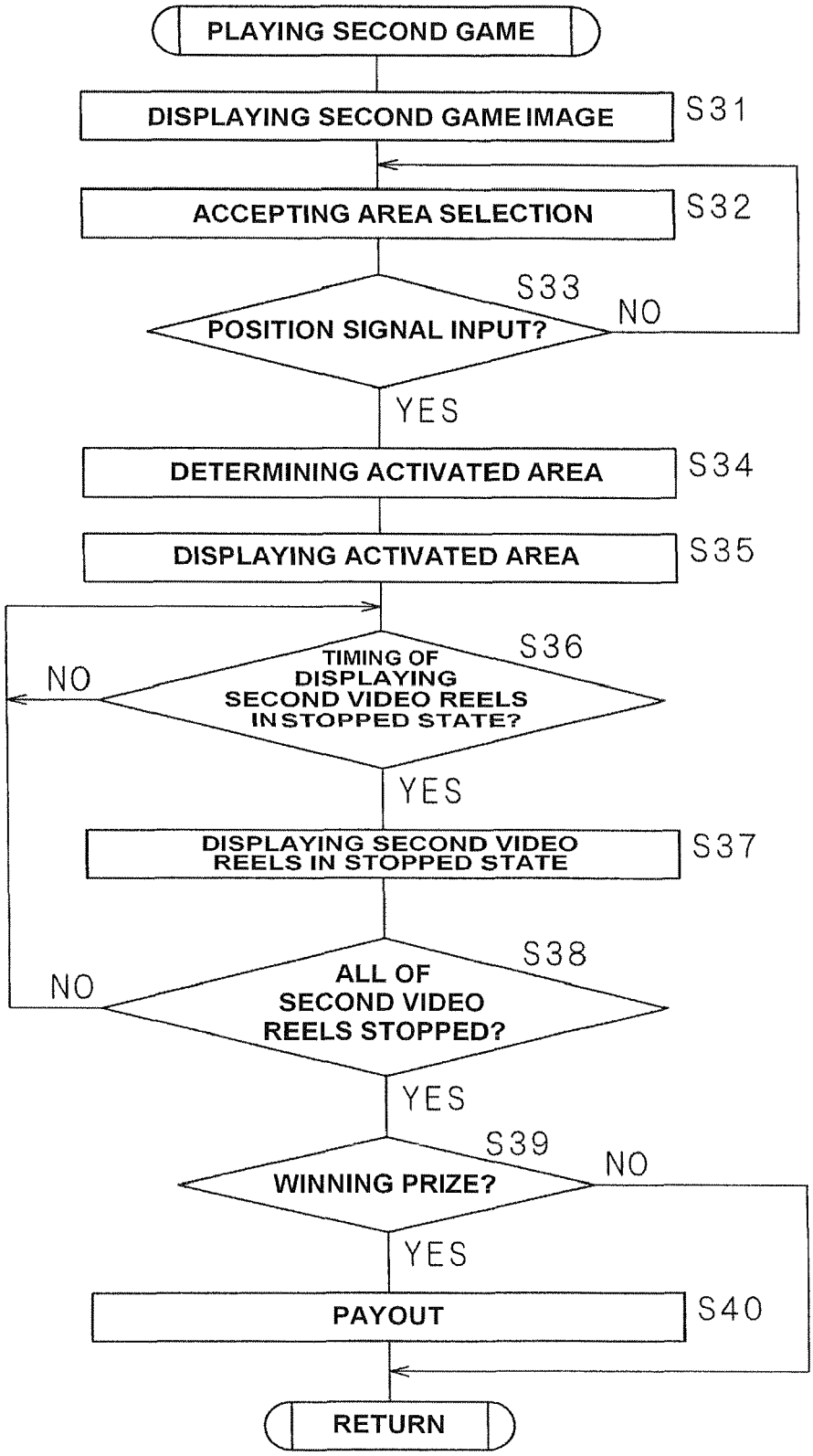
FIG. 14 is a flowchart showing a subroutine of procedures for executing a second game playing process at the gaming machine according to the first embodiment of the present invention.

FIG. 14 is a flowchart showing a subroutine of procedures for executing a second game playing process at the gaming machine according to the first embodiment of the present invention. The main CPU 20 starts a second game corresponding to one entire sheet completed in a base game, and then, displays a second game image in the display area 11*a* of the first liquid crystal display panel 11 (S31).

The main CPU 20 at S31 references a table such as a partial-picture table, and then, outputs to the sub CPU 40 a control signal which is indicative of the fact that a second game is started at the gaming machine 1 thereby displaying a second game image via the image control CPU 50 and the image control IC 54. After the process at S31 has been executed, the second video reels 32, 32, . . . , that continuously rotate while one entire sheet completed in a base game is employed as a background, are displayed (as shown in FIG. 7) in the second game image displayed in the display area 11*a*, wherein the luminance of the entire display area 11*a* is reduced significantly to that of the base game image.

After executing the process at S31, the main CPU 20 accepts a selection of an area to be formed as the activated area 11*b* (S32). At this time, the main CPU 20 causes an instruction for players to be displayed in a display area other than the display area 11*a* of the first liquid crystal display panel 11. This instruction is assigned to a player so as to select an area to be formed as the activated area 11*b* by touching the screen with one's finger F. The player operates the touch panel 18 with one's finger F so as to select the area to be formed as the activated area 11*b*.

Further, the main CPU 20 judges whether or not a position signal has been input from the touch panel 18 (S33). The judgment at S33 is made as to whether or not the touch panel 18 has accepted an area selection. If the position signal has not input yet (NO at S33), the main CPU 20 controls the routine to revert to S32, and thereafter, continuously accepts an area selection. If the position signal has been input from the touch panel 18 (YES at S33), i.e. the touch panel 18 has accepted an area selection, the main CPU 20 computes an area which is inclusive of the coordinate position of the site touched by the player, based upon the input position information, and then, determines the activated area 11*b* to be the computed area in the display area 11*a* (S34).

After that, the main CPU 20 causes the activated area 11*b* to be displayed in a state in which the luminance of the activated area 11*b* determined at S34 is higher than that of the display area 11*a* other than the activated area 11*b* (S35). After the process at S35 has been completed, a second game image as shown in FIG. 8 is displayed in the display area 11*a*. After the process at S35 is executed, prior to executing S36 (described later), the step of causing a player to verify whether or not the player selected area is employed as the activated area 11*b* may be executed.

The main CPU 20 judges whether or not a timing with which each of the second video reels 32 is to be displayed in a stopped state is established, based upon the elapsed time after the activated area 11*b* is displayed at S36. If the above timing is not established (NO at S36), the main CPU 20 repeats judgment made at S36 while continuing rotational display of each of the second video reels 32.

As to at least one of the second video reels 32, if a timing with which such second video reel 32 is to be displayed in a stopped state is established (YES at S36), the main CPU 20 causes each of the second video reels 32 to be displayed in a stopped state so that the symbols determined at S15, as to the second video reel 32 to be displayed in a stopped state, stop at the layout position determined at S15 (S37). Thus, the main CPU 20 at S37 outputs an appropriate control signal to the sub CPU 40 in accordance with the second reel identification information, the symbol identification information, and the layout position information that have been stored in the RAM 22, thereby displaying each of the second video reels 32 via the sub CPU 40, the image control CPU 50, and the image control IC 54.

In the present embodiment, at S37, each of the second video reels is displayed in a stopped state so that symbols stop at the layout position determined at S15. However, without being limitative thereto, the process at the step similar to that at S15 is re-executed after the process at S31 is executed, whereby the layout positions of symbols may be randomly determined again in accordance with each of the second video reels 32.

After the process at S37 has been completed, the main CPU 20 judges whether or not all of the three second video reels 32, 32, . . . have been stopped (S38). If at least one of the second video reels 32 is displayed in a rotating state (NO at S38), this CPU controls the routine to revert to S36, and then, judges a timing of stopping rotation of the second video reel 32 in action.

If all of the three second video reels 32, 32, . . . have been stopped (YES at S38), the main CPU 20 judges whether or not a winning prize has been established (S39). Thus, the main CPU 20 references the symbol table and the prize table for second game, that have been stored in the ROM 21, and the second reel identification information and the symbol identification information, that have been stored in the RAM 22, and then, judges whether or not specific symbols have stopped in the activated area 11*b*. In further detail, this CPU judges whether or not all of the symbols displayed in a stopped state in the activated area 11*b* are of a same kind.

If a winning prize is established (YES at S39), the main CPU 20 controls the hopper 141 via the hopper driving circuit 142, and then, pays out a predetermined number of coins (S40). Further, this CPU terminates the second game playing process, and then, controls processing to revert to its original routine. If no winning prize is established (NO at S39), the main CPU 20 terminates the second game playing process without executing the process at S40, and then, controls processing to revert to its original routine.

Second Embodiment

While, in the gaming machine 1 of the first embodiment, the activated area 11*b* was manually determined, this area is automatically determined in that of the present embodiment. Hereinafter, differences between the gaming machine 1 of the present embodiment and that of the first embodiment will be explained. Like constituent elements corresponding to the first embodiment are designated by like reference numerals, and a duplicate explanation thereof is omitted.

[2-1. Configuration of the Gaming Machine]

Figure 15:
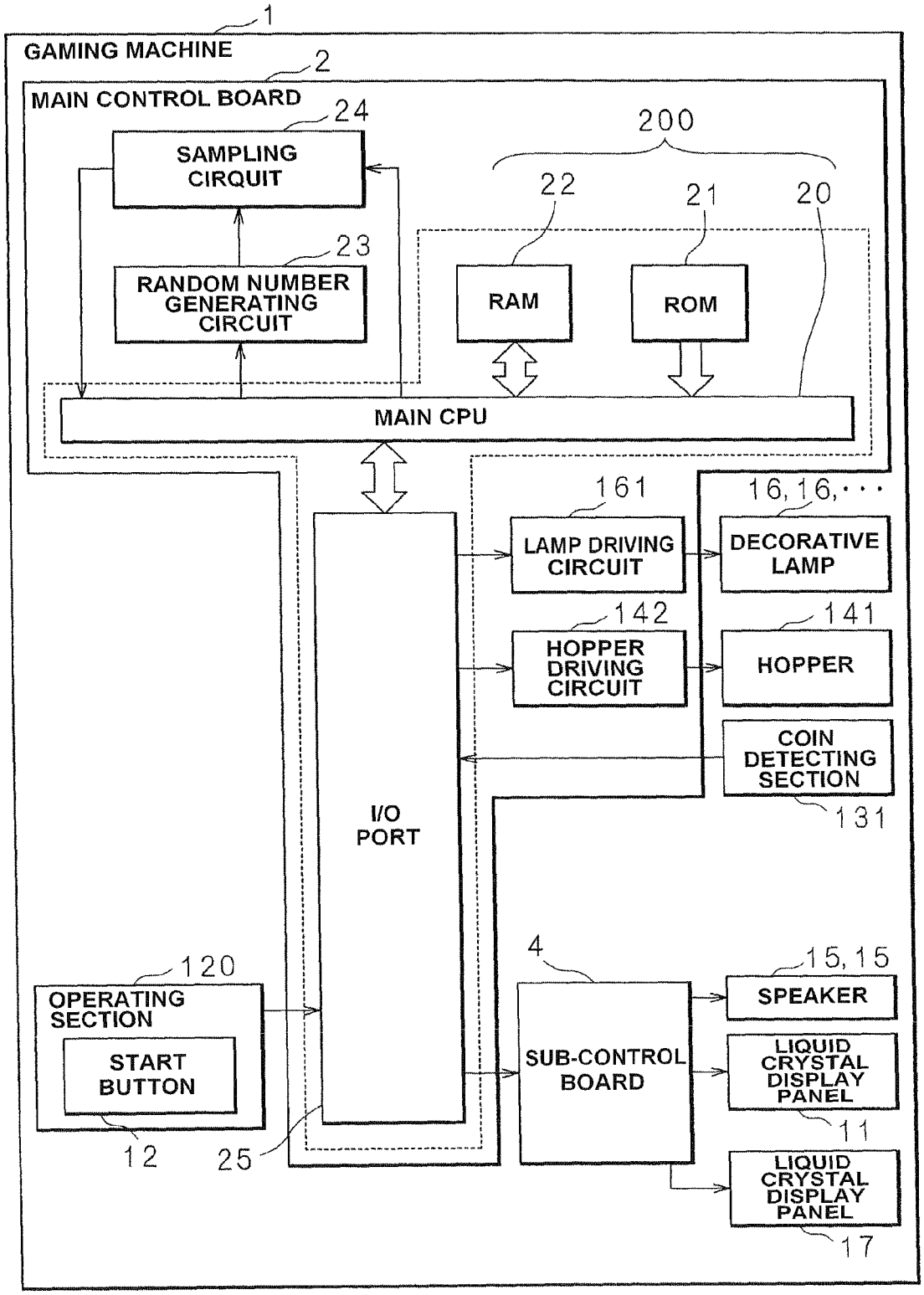
FIG. 15 is a block diagram depicting a configuration of essential portions of the gaming machine according to the second embodiment of the present invention.

FIG. 15 is a block diagram depicting a configuration of essential portions of the gaming machine according to the second embodiment of the present invention. The gaming machine 1 of the present embodiment is not provided with the touch panel 18. Further, the ROM 21 also stores a random number table for activated-area determination. As described previously, five candidates of an area to be formed as the activated area 11*b* exist in the display area 11*a*. The random number table for activated-area determination stores the ranges of random numbers and probabilities of determining each of the candidates as the activated area 11*b* in association with one another.

[2-2. Operation of the Gaming Machine]

The game control processing implemented by the gaming machine 1 of the embodiment is identical to that shown in FIG. 12. Further, the base game playing process to be implemented at the gaming machine 1 of the present embodiment is similar to that shown in each of FIGS. 13A and 13B.

Figure 16:
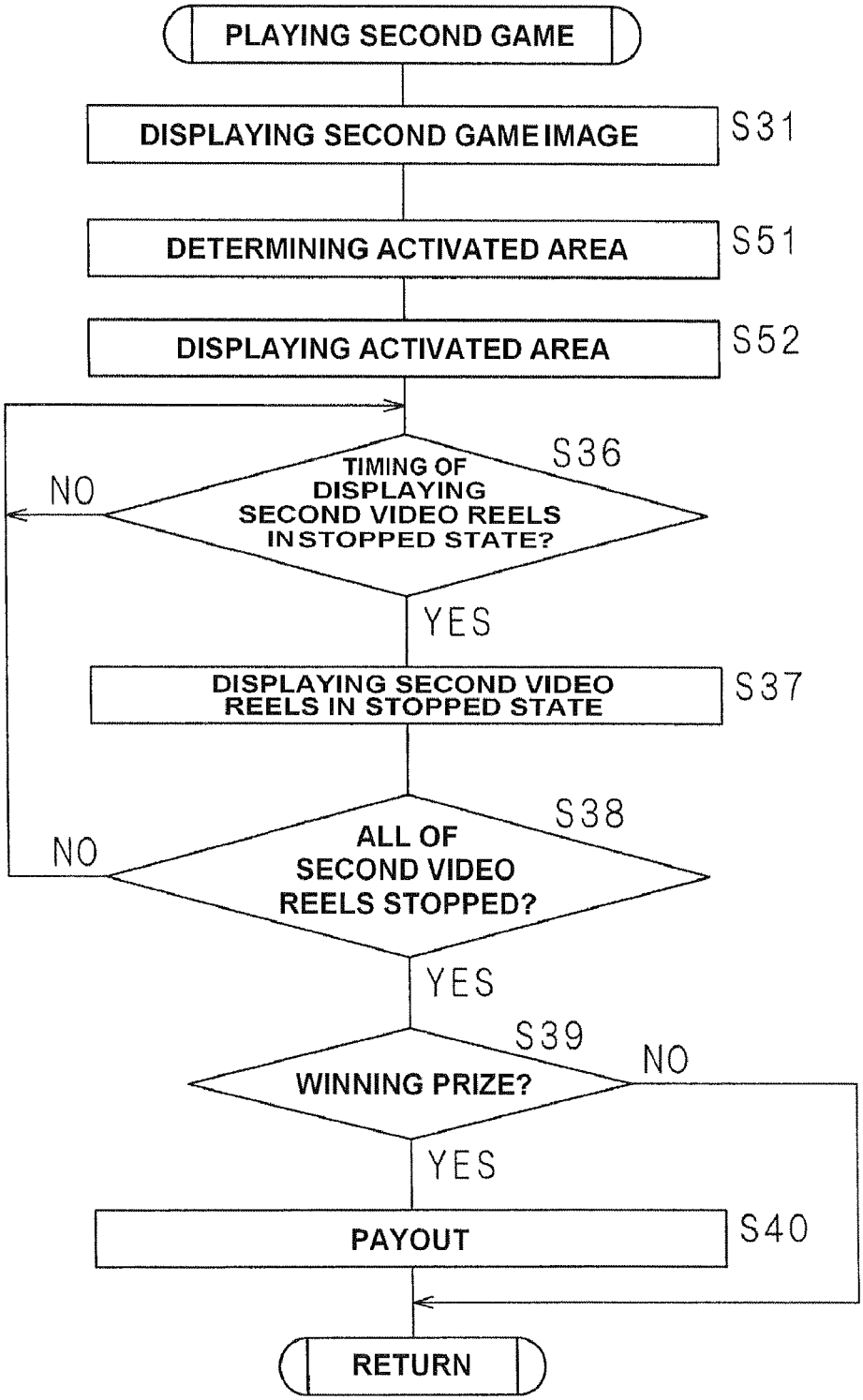
FIG. 16 is a flowchart showing a subroutine of procedures for executing a second game at the gaming machine according to the second embodiment of the present invention.

FIG. 16 is a flowchart showing a subroutine of procedures for executing a second game playing process at the gaming machine according to the second embodiment of the present invention. This second game playing process is invoked and executed in place of the subroutine of the second game playing process shown in FIG. 14, at S22 at which the base game processing shown in FIG. 13B was executed. The processes at S31 and S36 to S40 of the present embodiment are substantially similar to those shown in FIG. 14, and thus, a description thereof is omitted here.

After executing the process at S31, the main CPU 20 randomly determines the activated area 11*b* in the display area 11*a* (S51). In order to determine the activated area 11*b* at S51, the main CPU 20 references a table such as a random number table for activated-area determination, which has been stored in the ROM 21, and employs the random numbers that have been generated by the random number generating circuit 23 and sampled by the sampling circuit 24. After executing the process at S51, the main CPU 20 causes the activated area 11*b* to be displayed in a state in which the luminance of the activated area 11*b* determined at S51 is higher than that of the display area 11*a* other than the activated area 11*b* (S52). After executing the process at S52, the main CPU 20 executes the step that follows S36.

Third Embodiment

While, in the gaming machine 1 of the first embodiment, the first video reels 31, 31, . . . and the second video reels 32, 32, . . . are displayed in the display area 11*a* of the first liquid crystal display panel 11, the gaming machine 1 of the present embodiment is provided with mechanical reels 61, 61, . . . which are equivalent to the first video reels 31, 31, . . . without the first video reels being displayed. Hereinafter, differences between the gaming machine 1 of the present embodiment and that of the first embodiment will be explained. Like constituent elements corresponding to those of the first embodiment are designated by like reference numerals, and a duplicate explanation thereof is omitted.

[3-1. Configuration of the Gaming Machine]

Figure 17:
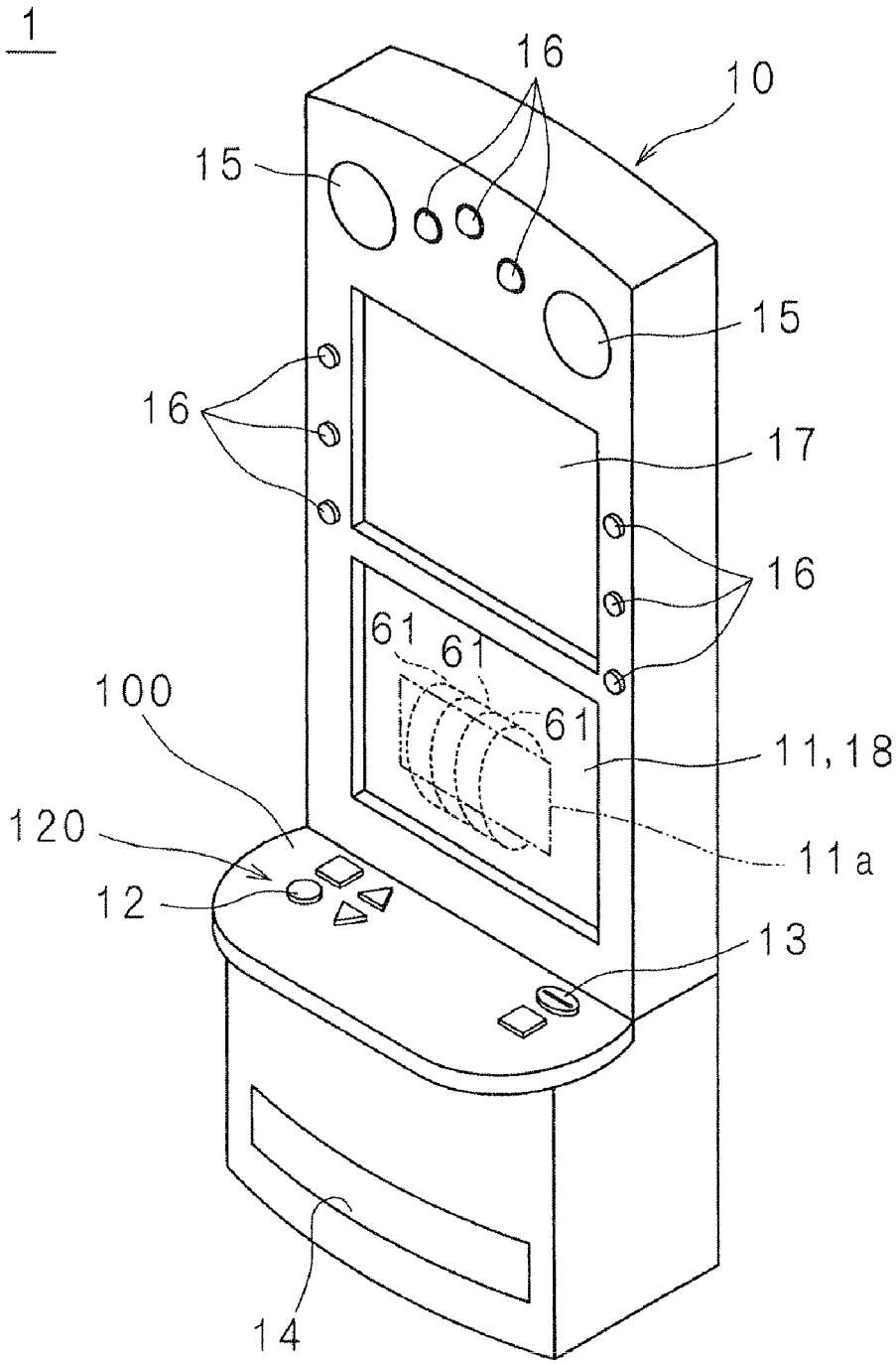
FIG. 17 is a perspective view showing an appearance of a gaming machine according to a third embodiment of the present invention.

FIG. 17 is a perspective view showing an appearance of a gaming machine according to the third embodiment of the present invention. At the cabinet 10, at the rear side of the first liquid crystal display panel 11, mechanical reels 61, 61, . . . are housed so that an axially vertical direction coincides with a horizontal direction. Each of the mechanical reels 61 has predetermined dimensions equivalent to those of one square in the axially vertical direction, and is formed by employing a transparent or semitransparent cylindrical member. On the mechanical reels 61, 61, . . . , (as is the case with the first video reels 31, 31, . . . ), of the first embodiment, the partial pictures of respective ones of plural kinds of pictures, as shown in FIG. 3, are arranged. However, the transparency of the mechanical reels 61 is not extremely affected by these partial pictures.

Although not shown, a light source serving as a backlight of the first liquid crystal display panel 11 is arranged inside of each of the mechanical reels 61, 61, . . . . The first liquid crystal display panel 11 is formed by employing a transparent liquid crystal display panel, and becomes opaque or semi-transparent by varying the transmittance of a liquid crystal. In the display area 11*a* of the first liquid crystal display panel 11, the transmittance of the liquid crystal is set so that portions at which symbols of each of the second video reels 32 are arranged are opaque and portions at which they are not arranged are transparent. On the other hand, in a display area other than the transparent area 11*a* of the first liquid crystal display panel 11, the transmittance of the liquid crystal is set so that the corresponding portion is opaque.

As a result thereof, where the first liquid crystal display panel 11 is visually recognized from a frontal side, the second video reels 32, 32, . . . are displayed as if they were arranged in front of the mechanical reels 61, 61, . . . . In further detail, the second video reels 32, 32, . . . are displayed in the display area 11*a* so that the mechanical reels 61, 61, . . . cannot be seen through the symbols arranged on each of the second video reels 32, whereas these reels can be seen through portions at which the above symbols are not arranged. As a result thereof, a player can readily visually recognize the partial pictures arranged on the mechanical reels 61, 61, . . . and the symbols arranged on the second video reels 32, 32, . . . in the display area 11*a*.

The player can see each of the mechanical reels 61, 61, . . . as if they were rotating upwardly in the display area 11*a*. As a result thereof, a player can see each of the partial pictures as if they were moving upwardly. Further, the player can see each of the second video reels 32, 32, . . . as if they were rotating in the rightward direction in the display area 11*a*. As a result thereof, the player can see symbols as if they were moving rightward.

On the other hand, the mechanical reels 61, 61, . . . can be seen through only the display area 11*a* of the first liquid crystal display panel 11. In other words, a player cannot see through the inside of the gaming machine 1 needlessly.

Figure 18:
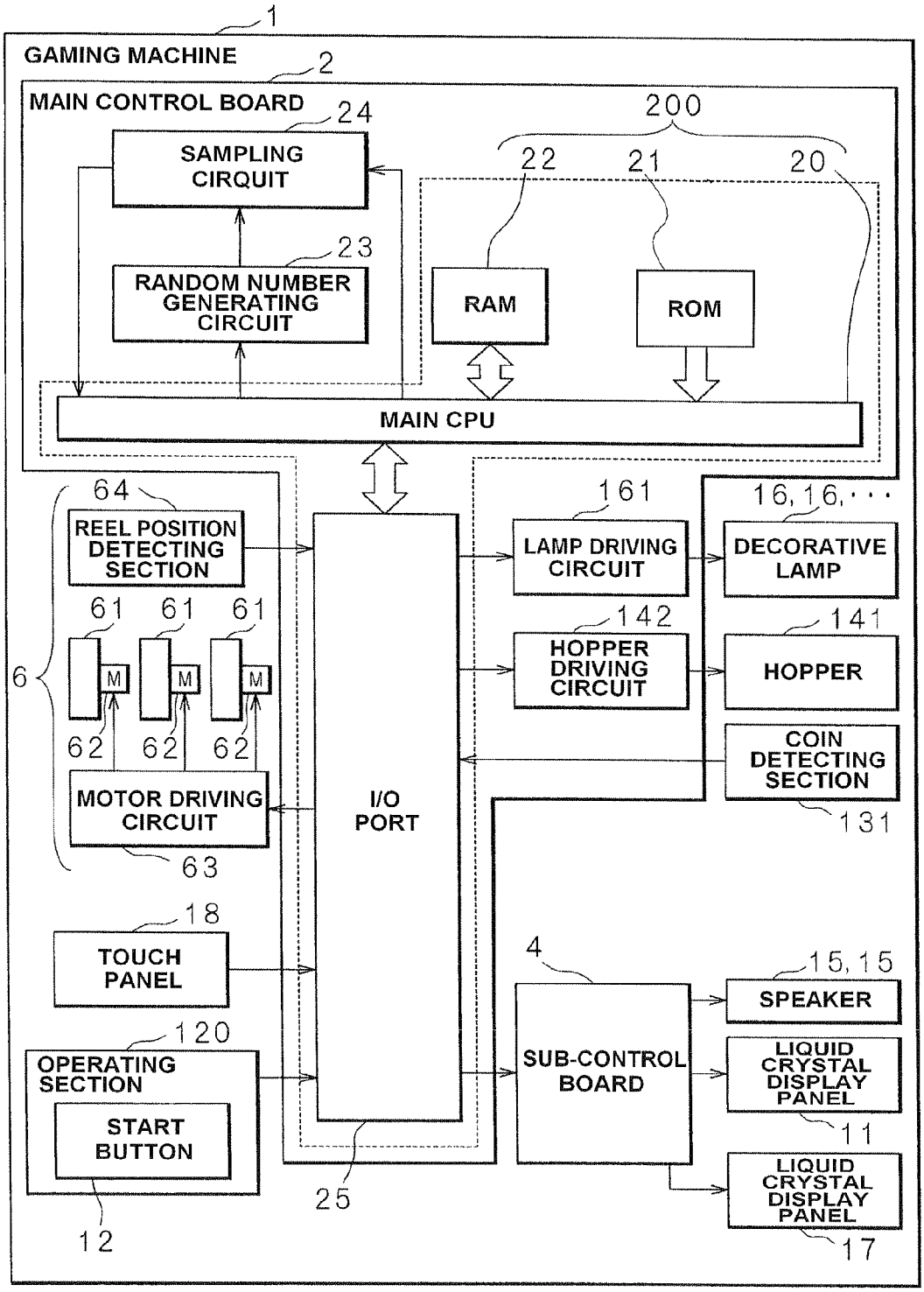
FIG. 18 is a block diagram depicting a configuration of essential parts of the gaming machine according to the third embodiment of the present invention.

FIG. 18 is a block diagram depicting a configuration of essential portions of the gaming machine according to the third embodiment of the present invention. The gaming machine 1 of the present embodiment is further provided with a reel driving unit 6, and the reel driving unit 6 includes mechanical reels 61, 61, . . . , reel motors 62, 62, . . . , a motor driving circuit 63, and a reel position detecting section 64. A motor driving circuit 63 and a reel position detecting section 64 are connected to an I/O port 25, and the reel motors 62, 62, . . . are connected to a motor driving circuit 63. A reel motor 62 is coupled with each of the mechanical reels 61. The reel motor 62 is activated, whereby the mechanical reel 61 rotates, and further, the reel motor 62 is deactivated, whereby the mechanical reel 61 stops.

The motor driving circuit 63 is controlled by means of the main CPU 20, outputs a drive signal of each of the reel motors 62, 62, . . . , and stops output of the drive signal. Each of the reel motors 62 is activated if the drive signal is input, and is not activated if the signal is not input. The reel position detecting section 64 detects a rotational position of each of the mechanical reels 61, and then, outputs the detected position to the main CPU 20. The main CPU 20 stops each of the mechanical reels 61 at its required rotational position, based upon the detection result input from the reel position detecting section 64. As a result thereof, the partial pictures arranged on each of the mechanical reels 61 stop at their required layout positions.

Where the player operates the start button 12, the main CPU 20 to which the start signal has been input from the operating section 120 starts rotation of each of the mechanical reels 61, via the motor driving circuit 63, and then, starts rotational display of each of the second video reels 32, via the sub-control board 4.

[3-2. Operation of the Gaming Machine]

Figure 19:
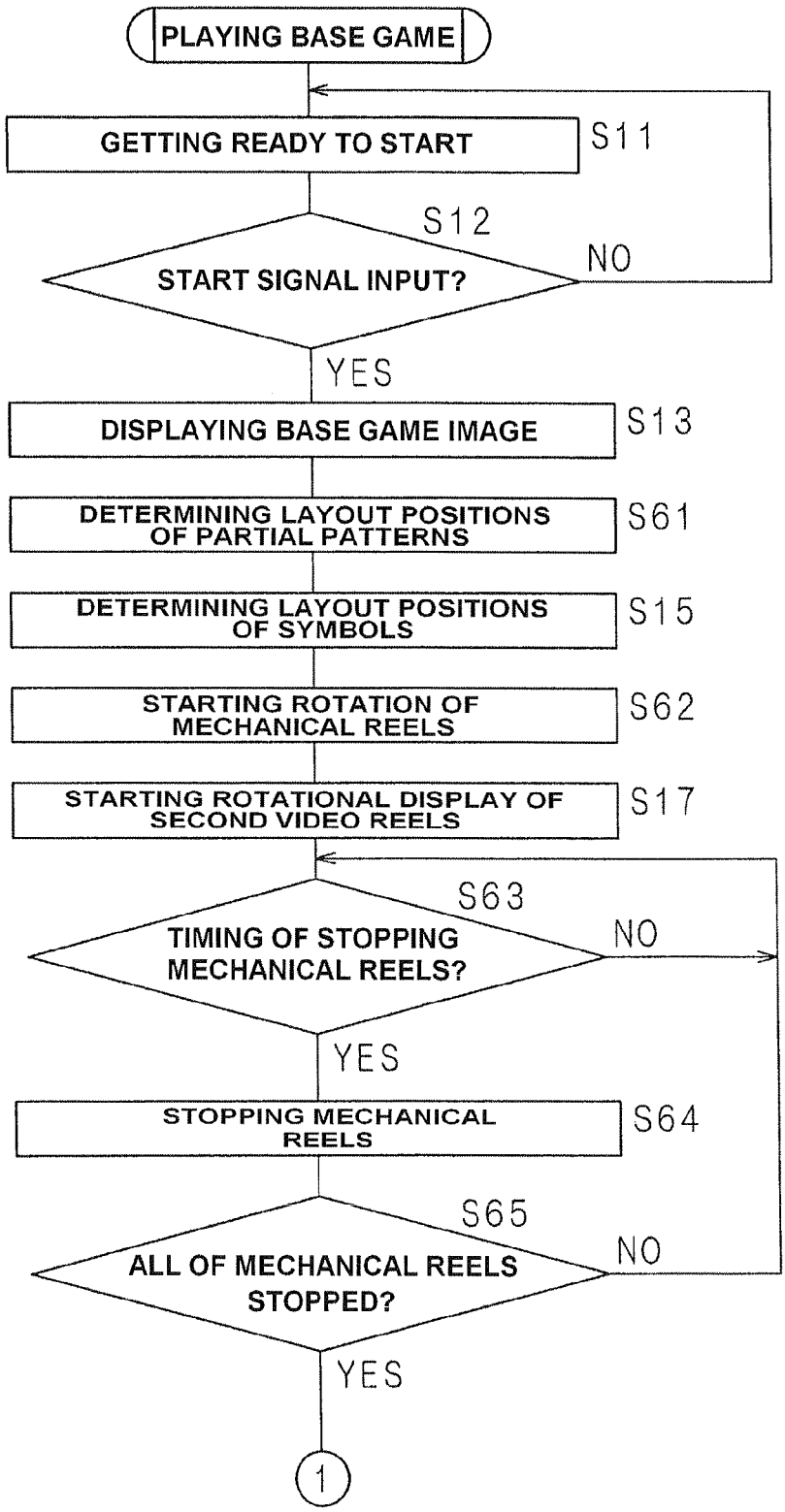
FIG. 19 is a flowchart showing a subroutine of procedures for executing a base game playing process at the gaming machine according to the third embodiment of the present invention.

The game control processing implemented by the gaming machine 1 of the embodiment is similar to that shown in FIG. 12. Further, the second game playing process implemented at the gaming machine 1 of the present embodiment is similar to that shown in FIG. 14. FIG. 19 is a flowchart showing a subroutine of procedures for executing a base game playing process at the gaming machine according to the third embodiment of the present invention. At S2 at which the game control process shown in FIG. 12 was performed, this base game playing process is invoked and executed in place of the subroutine of the base game playing process shown in FIGS. 13A and 13B. The processes at S11 to S13 and S15 and S17 of the present embodiment are substantially similar to those shown in FIG. 13A, and thus, a description thereof is omitted here.

After executing the process at S13, the main CPU 20 randomly determines the layout positions of partial pictures in response to each of the mechanical reels 61 (S61), and then, executes the process at S15. The layout positions of the partial pictures determined at S61 are vertical layout positions of the partial pictures to be stopped in a region corresponding to the display area 11*a*, if rotation of each of the mechanical reels 61 has stopped. After the completion of the process at S15, the main CPU 20 starts rotation of each of the mechanical reels 61 (S62), and then, executes the process at S17. The main CPU 20 at S62 outputs an appropriate signal to the motor driving circuit 63. The motor driving circuit 63 to which this signal has been input outputs a drive signal to each of the reel motors 62, 62, . . . , whereby rotation of each of the mechanical reels 61 is started.

Further, the main CPU 20 judges whether or not a timing (with which rotation of each of the mechanical reels 61 is to be stopped) is established, based upon an elapsed time after starting the rotation of each of the mechanical reels 61 (S63). If this timing is not established (NO at S63), the main CPU 20 repeats judgment made at S63 while continuing rotation of each of the mechanical reels 61. The elapsed time after starting rotation of each of the mechanical reels may be clocked using a timer (not shown), or alternatively, may be clocked by counting the number of clocks input from a clock generator (not shown) to the main CPU 20.

As to at least one mechanical reel 61, if a timing with which rotation of this mechanical reel 61 is to be stopped is established (YES at S63), the main CPU 20 causes the mechanical reel 61 to stop so that the partial pictures that have been determined at S61 as to the mechanical reel 61 to be stopped can stop at the layout position determined at S61 (S64). Thus, the main CPU 20 at S64 stops signal outputting to the motor driving circuit 63. The motor drive circuit 63 to which this signal has not been input stops output of the drive signal to each of the reel motors 62, 62, . . . , whereby each of the mechanical reels 61 stops rotation.

After the completion of the process at S64, the main CPU 20 judges whether or not all of the three mechanical reels 61, 61, . . . have been stopped (S65). If at least one of them is still rotating (NO at S65), this CPU controls the routine to revert to S63, and then, judges a timing of stopping rotation of the mechanical reel 61 in action. If all of the three mechanical reels 61, 61, . . . have been stopped (YES at S65), the main CPU 20 executes the processes at the steps that are substantially similar to those at S21 to S27 shown in FIG. 13B.

[3-3. Others]

The configuration of the gaming machine of the present invention is not limitative to that of the gaming machine 1 of the first and second embodiments, and various modifications can occur without departing from the spirit of the invention. For example, whether to manually or automatically determine the activated area 11*b* may be varied according to a predetermined condition. In addition, the activated area 11*b* may be highlighted by changing a color or enlarged dimensions, etc., in place of highlighting it by increasing or decreasing luminescence. Further, each of the first video reels 31 may be displayed in a rotating manner downwardly or horizontally, or alternatively, each of the second video reels 32 may be displayed in a rotating manner leftward or vertically.

What is claimed is:

1. A gaming machine, comprising:

a liquid crystal display section for displaying a plurality of first video reels which rotate in one direction and on which partial pictures of one entire sheet are arranged, respectively, and a plurality of second video reels through which the first video reels can be seen, which rotates in a direction crossing said one direction, and on which plural types of symbols are arranged, respectively;

a start accepting section, which accepts an operation of starting rotational display of the first video reels and rotational display of the second video reels; and a processor, which executes processes of:

(a) starting a base game, and then, randomly determining layout positions of partial pictures in correspondence with each of the first video reels in a case where the start accepting section accepts the operation;

(b) randomly determining layout positions of symbols in correspondence with each of the second video reels;

(c) rotationally displaying each of the first video reels;

(d) rotationally displaying each of the second video reels;

(e) displaying each of the first video reels in a stopped state so that the partial pictures of each of the first video reels stop at the layout positions determined in the process (a);

(f) displaying each of the second video reels in a stopped state so that symbols of each of the second video reels stop at the layout positions determined in the process (b) in a case where one entire sheet has not been completed by the partial pictures having stopped at the layout positions;

(g) establishing a prize corresponding to specific symbols in a case where the stopped symbols are the specific symbols;

(h) starting a second game, and then, determining an activated area in a display area of the liquid crystal display section, in a case where one entire sheet has been completed by the partial pictures having stopped at the layout position;

(i) displaying the activated area determined in the process (h);

(j) displaying each of the second video reels in a stopped state so that symbols of each of the second video reels stop at the layout positions determined in the process (b); and (k) establishing a prize corresponding to specific symbols or starting a second game in a case where the symbols having stopped at the layout positions are the specific symbols.

2. The gaming machine according to claim 1, wherein:

the process (h) is a process of starting a second game, and then, randomly determining an activated area in a display area of the liquid crystal display section, in a case where one entire sheet has been completed by the partial pictures having stopped at the layout position.

3. The gaming machine according to claim 1, further comprising a selection accepting section, which accepts an area selection in a case where a second game is started, wherein:

the process (h) is a process of starting the second game, and then, determining an activated area as the area accepted by the selection accepting section, in the display area of the liquid crystal display section.

4. The gaming machine according to claim 1, wherein:

the process (i) is a process of displaying the activated area in a state in which luminance of the activated area determined in the process (h) is higher than luminance of a display area other than the activated area.

5. A gaming machine, comprising:

a liquid crystal display section for displaying a plurality of first video reels which rotate in one direction and on which partial pictures of one entire sheet are arranged, respectively, and a plurality of second video reels through which the first video reels can be seen, which rotates in a direction crossing said one direction, and on which plural types of symbols are arranged, respectively;

a start accepting section, which accepts an operation of starting rotational display of the first video reels and rotational display of the second video reels; and a processor, which executes processes of:

(a) starting a base game, and then, randomly determining layout positions of partial pictures in correspondence with each of the first video reels in a case where the start accepting section accepts the operation;

(b) randomly determining layout positions of symbols in correspondence with each of the second video reels;

(c) rotationally displaying each of the first video reels;

(d) rotationally displaying each of the second video reels;

(e) displaying each of the first video reels in a stopped state so that the partial pictures of each of the first video reels stop at the layout positions determined in the process (a);

(f) displaying each of the second video reels in a stopped state so that symbols of each of the second video reels stop at the layout positions determined in the process (b) in a case where one entire sheet has not been completed by the partial pictures having stopped at the layout positions;

(g) establishing a prize corresponding to specific symbols in a case where the stopped symbols are the specific symbols;

(h) starting a second game, and then, randomly determining an activated area in a display area of the liquid crystal display section, in a case where one entire sheet has been completed by the partial pictures having stopped at the layout position;

(i) displaying the activated area determined in the process (h);

(j) displaying each of the second video reels in a stopped state so that symbols of each of the second video reels stop at the layout positions determined in the process (b); and (k) establishing a prize corresponding to specific symbols or starting a second game in a case where the symbols having stopped at the layout positions are the specific symbols.

6. A gaming machine, comprising:

a liquid crystal display section for displaying a plurality of first video reels which rotate in one direction and on which partial pictures of one entire sheet are arranged, respectively, and a plurality of second video reels through which the first video reels can be seen, which rotates in a direction crossing said one direction, and on which plural types of symbols are arranged, respectively;

a start accepting section, which accepts an operation of starting rotational display of the first video reels and rotational display of the second video reels; and a processor, which executes processes of:

(a) starting a base game, and then, randomly determining layout positions of partial pictures in correspondence with each of the first video reels in a case where the start accepting section accepts the operation;

(b) randomly determining layout positions of symbols in correspondence with each of the second video reels;

(c) rotationally displaying each of the first video reels;

(d) rotationally displaying each of the second video reels;

(e) displaying each of the first video reels in a stopped state so that the partial pictures of each of the first video reels stop at the layout positions determined in the process (a);

(f) displaying each of the second video reels in a stopped state so that symbols of each of the second video reels stop at the layout positions determined in the process (b) in a case where one entire sheet has not been completed by the partial pictures having stopped at the layout positions;

(g) establishing a prize corresponding to specific symbols in a case where the stopped symbols are the specific symbols;

(h) starting a second game, and then, determining an activated area in a display area of the liquid crystal display section, in a case where one entire sheet has been completed by the partial pictures having stopped at the layout position;

(i) displaying the activated area in a state in which luminance of the activated area determined in the process (h) is higher than luminance of a display area other than the activated area;

(j) displaying each of the second video reels in a stopped state so that symbols of each of the second video reels stop at the layout positions determined in the process (b); and (k) establishing a prize corresponding to specific symbols or starting a second game in a case where the symbols having stopped at the layout positions are the specific symbols.

7. A gaming machine, comprising:

a plurality of mechanical reels, which rotate in one direction and on which partial pictures of one entire sheet are arranged, respectively;

a liquid crystal display section for displaying a plurality of video reels through which the mechanical reels can be seen, which rotate in said one direction, and on which plural types of symbols are arranged, respectively;

a start accepting section, which accepts an operation of starting rotation of the mechanical reels and rotational display of the video reels; and a processor, which executes processes of:

(a) starting a base game, and then, randomly determining layout positions of partial pictures in correspondence with each of the first video reels in a case where the start accepting section accepts the operation;

(b) randomly determining layout positions of symbols in correspondence with each of the video reels;

(c) rotating each of the mechanical reels;

(d) rotationally displaying each of the video reels;

(e) stopping each of the mechanical reels so that partial pictures of each of the mechanical reels stop at the layout positions determined in the process (a);

(f) displaying each of the video reels in a stopped state so that symbols of each of the video reels stop at the layout positions determined in the process (b) in a case where one entire sheet has not been completed by the partial pictures having stopped at the layout positions;

(g) establishing a prize corresponding to specific symbols in a case where the symbols having stopped are the specific symbols;

(h) starting a second game, and then, determining an activated area in a display area of the liquid crystal display section, in a case where one entire sheet has been completed by the partial pictures having stopped at the layout position;

(i) displaying the activated area determined in the process (h);

(j) displaying each of the video reels in a stopped state so that symbols of each of the video reels stop at the layout positions determined in the process (b); and (k) establishing a prize corresponding to specific symbols or starting a second game in a case where the symbols having stopped at the layout positions are the specific symbols.

8. A control method of a gaming machine which has:

a liquid crystal display section for displaying a plurality of first video reels which rotate in one direction and on which partial pictures of one entire sheet are arranged, respectively, and a plurality of second video reels through which the first video reels can be seen, which rotates in a direction crossing said one direction, and on which plural types of symbols are arranged, respectively; and a start accepting section, which accepts an operation of starting rotational display of the first video reels and rotational display of the second video reels, said method comprising the steps of:

(a) starting a base game, and then, randomly determining layout positions of partial pictures in correspondence with each of the first video reels in a case where the start accepting section accepts the operation;

(b) randomly determining layout positions of symbols in correspondence with each of the second video reels;

(c) rotationally displaying each of the first video reels;

(d) rotationally displaying each of the second video reels;

(e) displaying each of the first video reels in a stopped state so that the partial pictures of each of the first video reels stop at the layout positions determined in the process (a);

(f) displaying each of the second video reels in a stopped state so that symbols of each of the second video reels stop at the layout positions determined in the process (b) in a case where one entire sheet is not completed by the partial pictures having stopped at the layout positions;

(g) establishing a prize corresponding to specific symbols in a case where the stopped symbols are the specific symbols;

(h) starting a second game, and then, determining an activated area in a display area of the liquid crystal display section, in a case where one entire sheet has been completed by the partial pictures having stopped at the layout position;

(i) displaying the activated area determined in the process (h);

(j) displaying each of the second video reels in a stopped state so that symbols of each of the second video reels stop at the layout positions determined in the process (b); and (k) establishing a prize corresponding to specific symbols or starting a second game in a case where the symbols having stopped at the layout positions are the specific symbols.

* * * * *